US011964835B2

(12) United States Patent
Araki et al.

(10) Patent No.: US 11,964,835 B2
(45) Date of Patent: Apr. 23, 2024

(54) MEDIUM FEEDING DEVICE AND MEDIUM PROCESSING APPARATUS INCLUDING THE SAME

(71) Applicant: FUJIFILM Business Innovation Corp., Tokyo (JP)

(72) Inventors: Yuichi Araki, Kanagawa (JP); Masahito Niwa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 172 days.

(21) Appl. No.: 17/225,139

(22) Filed: Apr. 8, 2021

(65) Prior Publication Data

US 2022/0081233 A1 Mar. 17, 2022

(30) Foreign Application Priority Data

Sep. 13, 2020 (JP) ..... 2020-153404

(51) Int. Cl.
*B65H 3/08* (2006.01)
*B65H 1/08* (2006.01)

(52) U.S. Cl.
CPC ..... *B65H 1/08* (2013.01); *B65H 3/08* (2013.01)

(58) Field of Classification Search
CPC ... B65H 1/08; B65H 3/08; B65H 3/48; B65H 3/0816; B65H 2511/524
See application file for complete search history.

(56) References Cited

U.S. PATENT DOCUMENTS 6,398,207 B1 6/2002 Taylor et al.
2006/0170145 A1* 8/2006 Nakane ..... B65H 3/48 271/97
2011/0193284 A1* 8/2011 Fuda ..... B65H 7/16 271/276
2012/0133092 A1* 5/2012 Fuda ..... B65H 3/14 271/104
2014/0339759 A1* 11/2014 Takahashi ..... B65H 3/08 271/227

FOREIGN PATENT DOCUMENTS

JP 4871455 2/2012

* cited by examiner

*Primary Examiner* — Howard J Sanders
(74) *Attorney, Agent, or Firm* — JCIPRNET

(57) ABSTRACT

A medium feeding device includes a storage unit that stores media in a form of a sheet, a delivery unit that is disposed downstream in a medium delivery direction relative to the media stored in the storage unit and that delivers the media individually, a transfer unit that is disposed above the storage unit and that adheres by suction to each of the media stored in the storage unit and transfers the media to the delivery unit, and a fluffing unit that is disposed beside the media stored in the storage unit in a direction intersecting the medium delivery direction. The fluffing unit fluffs an upper-side region of the media in a state of being separated, by blowing air toward a side of the media during a feeding job of the media and during a post-feeding period that is a predetermined period after completion of the feeding job. The medium feeding device further includes a suppression unit that suppresses movement of the media toward the delivery unit side during air blowing performed by the fluffing unit in the post-feeding period.

7 Claims, 20 Drawing Sheets

MEDIUM FEEDING DEVICE AND MEDIUM PROCESSING APPARATUS INCLUDING THE SAME

CROSS-REFERENCE TO RELATED APPLICATIONS

This application is based on and claims priority under 35 USC 119 from Japanese Patent Application No. 2020-153404 filed Sep. 13, 2020.

BACKGROUND

(i) Technical Field

The present disclosure relates to a medium feeding device and a medium processing apparatus including the medium feeding device.

(ii) Related Art

Japanese Patent No. 4871455 (refer to DETAILED DESCRIPTION OF THE INVENTION and FIG. 19) discloses a sheet feeding apparatus including a transport roller on the sheet feeding side relative to a sheet tray. In the sheet feeding apparatus, sheets stored in the sheet tray are fluffed by using air, and an air plenum adheres by suction to the uppermost sheet and transfers the sheet to the transport roller.

SUMMARY

Aspects of non-limiting embodiments of the present disclosure relate to addressing a technical challenge to suppressing movement of media downstream in the medium delivery direction during air blowing of the media in a post-feeding period that is a period after completion of the feeding job, when a method of blowing air toward a stored media stack from a position beside the media stack during a feeding job of the media or during the post-feeding period is adopted.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a medium feeding device including a storage unit that stores media in a form of a sheet, a delivery unit that is disposed downstream in a medium delivery direction relative to the media stored in the storage unit and that delivers the media individually, a transfer unit that is disposed above the storage unit and that adheres by suction to each of the media stored in the storage unit and transfers the media to the delivery unit, and a fluffing unit that is disposed beside the media stored in the storage unit in a direction intersecting the medium delivery direction. The fluffing unit fluffs an upper-side region of the media in a state of being separated, by blowing air toward a side of the media during a feeding job of the media and during a post-feeding period that is a predetermined period after completion of the feeding job. The medium feeding device further includes a suppression unit that suppresses movement of the media toward the delivery unit side during air blowing performed by the fluffing unit in the post-feeding period.

BRIEF DESCRIPTION OF THE DRAWINGS

Exemplary embodiments of the present disclosure will be described in detail based on the following figures, wherein.

DETAILED DESCRIPTION

Outline of Exemplary Embodiments

Figure 1A:
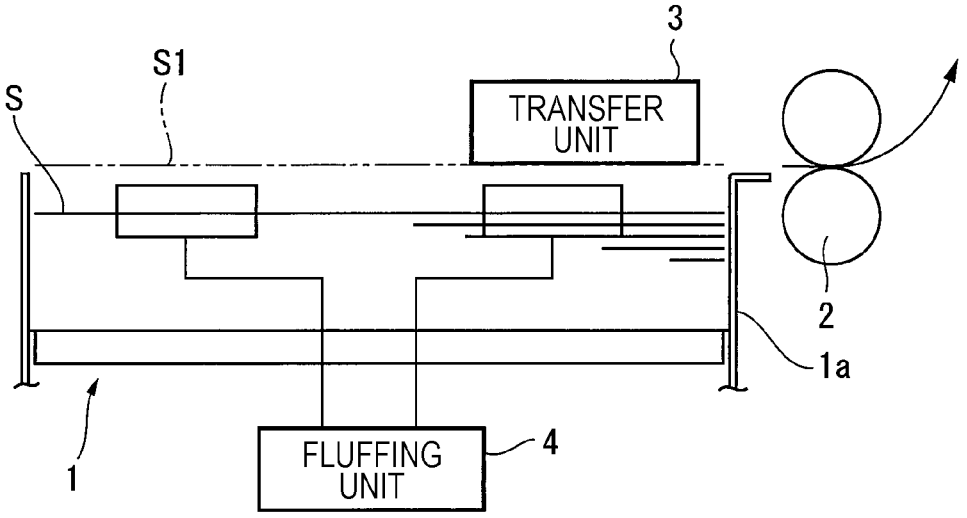
FIG. 1A illustrates schematically a medium feeding device according to an exemplary embodiment of the present disclosure.

FIG. 1A illustrates schematically a medium feeding device according to an exemplary embodiment of the present disclosure.

The medium feeding device illustrated in FIG. 1A feeds media S in a form of a sheet individually. Other than a case of being used alone, the medium feeding device is implemented in a form of a medium processing apparatus by being used, for example, in combination with a processing unit (not illustrated in FIGS. 1A to 1C) that performs predetermined processing on the media S that have been fed. The processing unit here may be any unit such as an image forming unit that forms an image on a medium or a coating unit that performs coating on a medium.

Figure 1B:
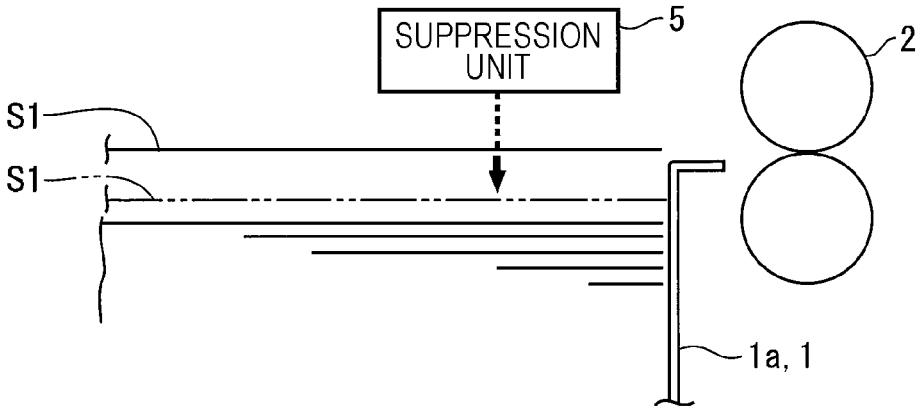
FIG. 1B illustrates the medium feeding device with an example of a suppression unit.
Figure 1C:
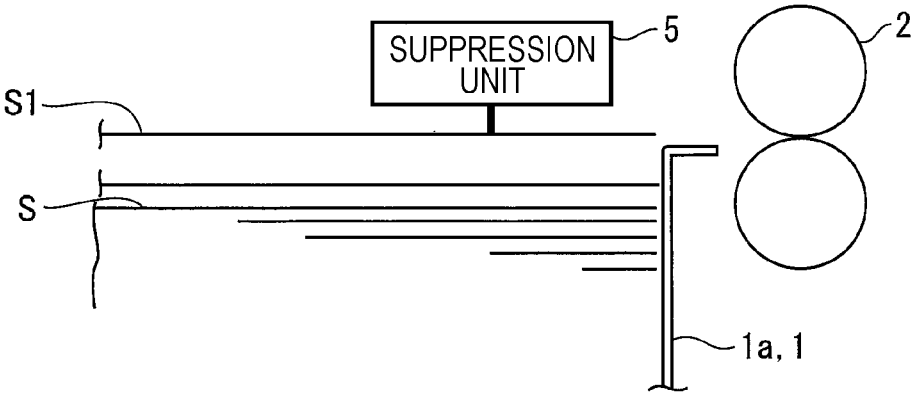
FIG. 1C illustrates another example of the suppression unit.

In the present exemplary embodiment, as FIG. 1A illustrates, the medium feeding device includes a storage unit 1 that stores media S in a form of a sheet, a delivery unit 2 that is disposed downstream in a medium delivery direction relative to the media S stored in the storage unit 1 and that delivers the media S individually, a transfer unit 3 that is disposed above the storage unit 1 and that adheres by suction to each of the media S stored in the storage unit 1 and transfers the media S to the delivery unit 2, and a fluffing unit 4 that is disposed beside the media S stored in the storage unit 1 in a direction intersecting the medium delivery direction. The fluffing unit 4 fluffs an upper-side region of the media S in a state of being separated, by blowing air toward a side of the media S during a feeding job of the media S and during a post-feeding period that is a predetermined period after completion of the feeding job. As FIGS. 1B and 1C illustrate, the medium feeding device further includes a suppression unit 5 that suppresses movement of the media S toward the delivery unit 2 side during air blowing performed by the fluffing unit 4 in the post-feeding period.

In such a technical configuration, the storage unit 1 typically has a stacking portion on which media S are to be stacked. A type that stores media S of a variety of sizes has, at a position beside the media S in a direction intersecting the delivery direction of the media S, a side guide portion that guides media S for positioning the media S, or the type has, at a rear position upstream in the delivery direction of media S, a rear guide portion that guides the media S for positioning the media S. The storage unit 1 is often withdrawable with respect to a housing of the medium feeding device in view of media S supplement capability.

The delivery unit 2 may be any delivery unit having a function of delivering media S. For example, paired delivery rollers and a combination of a delivery roller and a delivery belt are representative. In such cases, the function may be achieved by nipping and delivering a medium S1 that is to be delivered in a nip region between paired delivery members. For example, when the delivery unit 2 is a pair of rollers, the medium S1 is nipped in a region (nip region) in which the paired rollers are in contact with one another, and one of the paired rollers may also transport a belt, and the rollers may hold the belt therebetween.

In this example, the transfer unit may be selected appropriately from any type that adheres by suction to each of the media S stored in the storage unit 1, transfers the media to the delivery unit individually, and returns to an initial position.

The fluffing unit 4 may be selected appropriately from any type that blows air toward an upper-side region of the media S stored in the storage unit 1 from a position beside the storage unit 1.

Here, an air blowing operation is performed by the fluffing unit 4 during not only a media feeding job but also the post-feeding period, which is the period after completion of the feeding job, because the intention is to start a feeding operation of media S without waiting time, even if an instruction to perform the next feeding job is provided immediately after completion of the feeding job. Although the "post-feeding period" in this example denotes the period after completion of the feeding job of media, the post-feeding period does not include the entire period from completion of the feeding job of the media until an instruction for the next feeding job is provided but rather is a predetermined period after the feeding job completion or a period that may be appropriately selected by a user. Such a post-feeding period is often selected in view of the frequency of performing a feeding job, and, when an instruction for the next feeding job is not provided within the post-feeding period, the fluffing unit 4 may be caused to stop performing the air blowing operation for a moment.

As FIGS. 1B and 1C illustrate, the suppression unit 5 may be any unit that suppresses a fluffed medium S1 from advancing toward the delivery unit 2 side during the air blowing in the post-feeding period, and representative units are divided into two types: a type that lowers the position of the fluffed medium to a position at which the medium does not advance (refer to FIG. 1B); and a type that restrains the fluffed medium so that the fluffed medium does not move (refer to FIG. 1C).

Next, a representative example or other examples of the suppression unit 5 will be described.

Regarding the type illustrated in FIG. 1B, the storage unit 1 has, on the delivery unit 2 side, a stopper wall 1*a* capable of retaining media S stored in the storage unit 1 when the fluffing unit 4 is not used, and the suppression unit 5 lowers the position of a downstream end portion, in the delivery direction, of a medium S1 fluffed during the air blowing in the post-feeding period to a position within a retainable region of the stopper wall 1*a*.

In this example, the suppression unit 5 may have an air blowing unit (not illustrated in FIG. 1B) that blows air moving downward from an upper side toward the downstream end portion, in the delivery direction, of the medium S1 fluffed during the air blowing in the post-feeding period, and the suppression unit 5 may lower the position of the downstream end portion of the medium S1 in the delivery direction.

Here, the air blowing unit, as an example, blows air moving diagonally downward from an upper side in a direction away from the delivery unit 2, toward the downstream end portion of the fluffed medium S1 in the delivery direction.

Alternatively, in the suppression unit 5, as another example of this type, the storage unit 1 has a raising/lowering unit (not illustrated in FIG. 1B) that raises and lowers media S, and, during the air blowing in the post-feeding period, the suppression unit 5 lowers the raising/lowering unit to place a fluffed medium S1 into the retainable region of the stopper wall 1*a*.

Regarding the type illustrated in FIG. 1C, the suppression unit 5 may restrain the medium S1 fluffed during the air blowing in the post-feeding period so that the medium S1 does not move downstream in the delivery direction.

In this example, in the suppression unit 5, the transfer unit 3 may adhere by suction to the medium S1 fluffed during the air blowing in the post-feeding period. In the suppression unit 5, as another example of this type, the storage unit 1 has, on the delivery unit 2 side, the stopper wall 1*a* capable of retaining media S stored in the storage unit 1 when the fluffing unit is not used, and the suppression unit 5 raises the stopper wall 1*a* of the storage portion 1 so that the stopper wall 1*a* retains the downstream end portion of the fluffed medium S1 in the delivery direction during the air blowing in the post-feeding period.

Hereinafter, exemplary embodiments of the present disclosure will be described in more detail with reference to the accompanying drawings.

First Exemplary Embodiment

Figure 2:
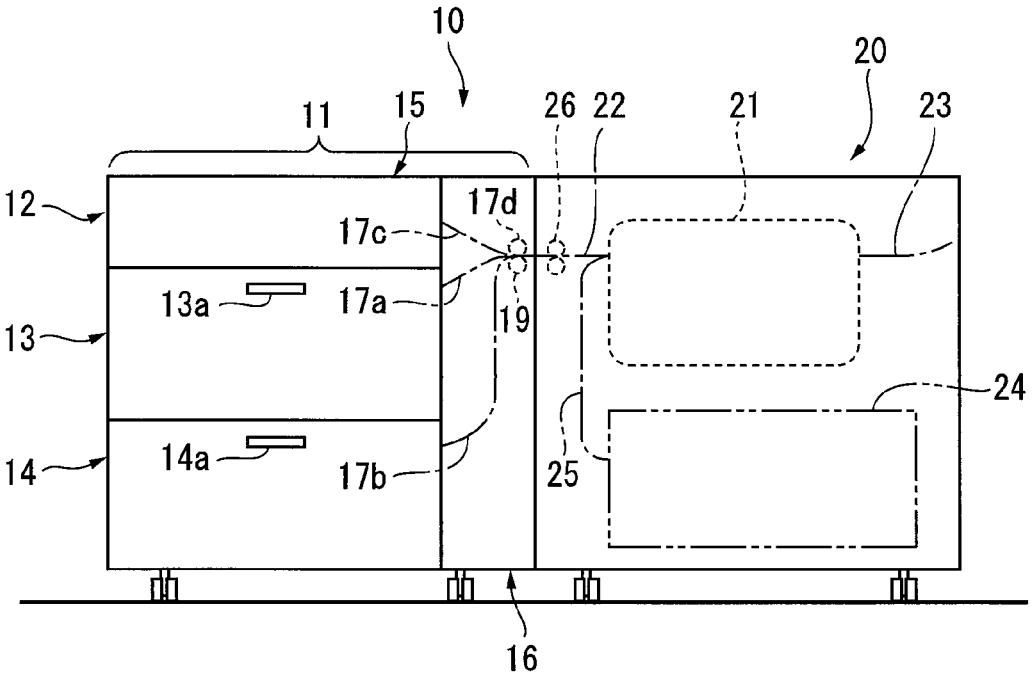
FIG. 2 illustrates the overall configuration of a medium processing apparatus according to a first exemplary embodiment.

FIG. 2 illustrates the overall configuration of a medium processing apparatus according to a first exemplary embodiment.

Overall Configuration of Medium Processing Apparatus

In FIG. 2, a medium processing apparatus 10 includes a medium feeding device 11 that feeds media in a form of a sheet individually and a processing unit 20 as a processing unit that performs predetermined processing on the media that have been fed from the medium feeding device 11.

In this example, the processing unit 20 includes an image forming portion 21 that forms images on the media. The image forming portion 21 may adopt various image forming systems such as an electrophotographic system or an ink-jet recording system. The processing unit 20 includes an inbound transport path 22 used to transport the media that are fed from the medium feeding device 11 into the image forming portion 21 and an outbound transport path 23 used to transport the media on which images have been formed by the image forming portion 21 out of the processing unit 20. In this example, a built-in medium feeding portion 24 is further separately provided below the image forming portion 21 in the processing unit 20, and media that are fed from the medium feeding portion 24 are also fed into the image forming portion 21 via a feeding transport path 25. Reference 26 denotes an inbound transport roller 26 disposed at the entrance of the inbound transport path 22, and the appropriate number of transport members are provided in the inbound transport path 22, the outbound transport path 23, and the feeding transport path 25.

Overall Configuration of Medium Feeding Device

Figure 3:
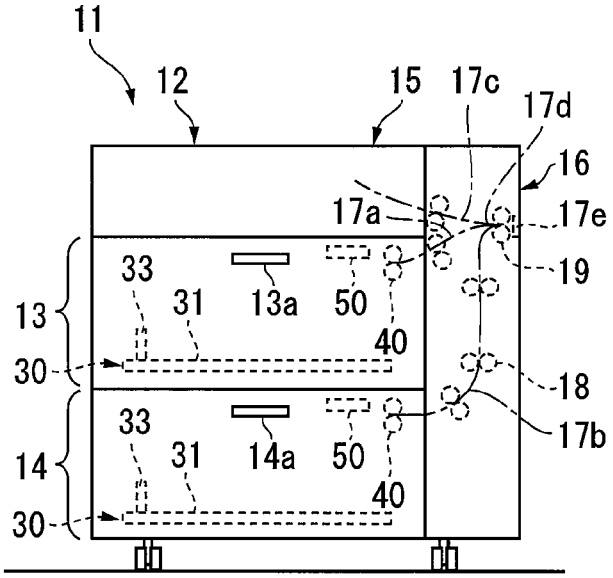
FIG. 3 illustrates an example of a medium feeding device used for the medium processing apparatus according to the first exemplary embodiment.

In this example, as FIGS. 2 and 3 illustrate, the medium feeding device 11 has a housing 12 that stores media, and, in the housing 12, an upper drawer 13 and a lower drawer 14 that are two-layer drawer-type drawers are provided so as to be withdrawn. In addition, a manual feeding portion 15 by which media are enabled to be fed manually is disposed in an upper portion of the housing 12. On the processing unit 20 side of the housing 12, a relay unit 16 that relays and transports media that are fed from the upper drawer 13, the lower drawer 14, and the manual feeding portion 15 to the processing unit 20 side is provided.

In this example, both the upper drawer 13 and the lower drawer 14 store a large amount of media and feed the media individually. The relay unit 16 includes a first outbound transport path 17*a* used to transport outward the media that are fed from the upper drawer 13, a second outbound transport path 17*b* used to transport outward the media that are fed from the lower drawer 14, and a third outbound transport path 17*c* used to transport outward the media that are fed from the manual feeding portion 15. The first to third outbound transport paths 17*a* to 17*c* have the appropriate number of transport rollers 18, and a merging transport path 17*d* that is connected to an outlet 17*e* to the processing unit 20 is formed on the exit side of each of the first to third outbound transport paths 17*a* to 17*c*. The merging transport path 17*d* includes a discharging roller 19. The upper drawer 13 and the lower drawer 14 have handles 13*a* and 14*a*, respectively, and are capable of being withdrawn frontward.

Configuration Example of Upper Drawer (Lower Drawer)

In this example, the upper drawer 13 and the lower drawer 14 have configurations substantially similar to one another. Hereinafter, the drawers will be described by referring to an example of the upper drawer 13.

Figure 4:
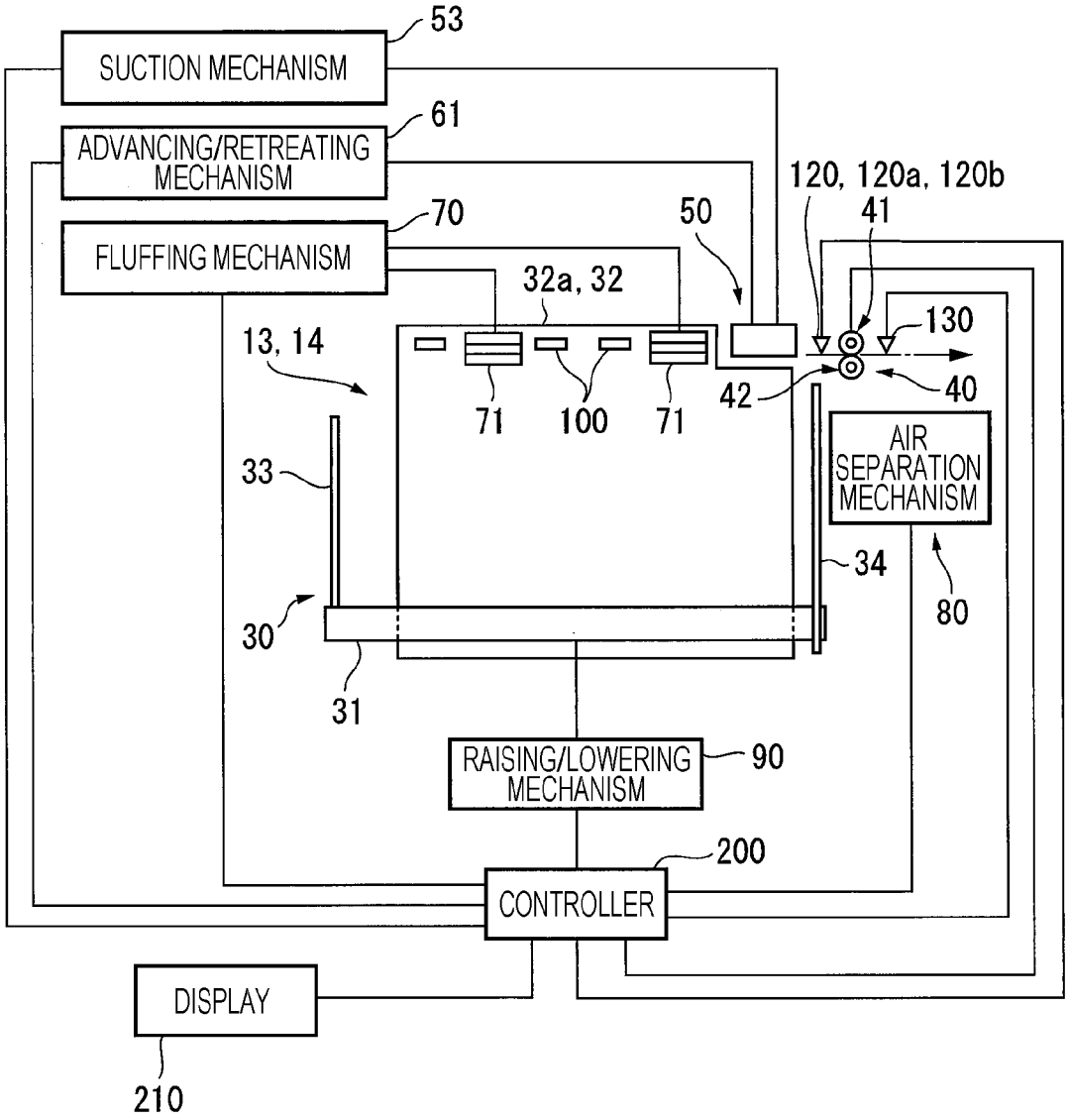
FIG. 4 illustrates a control system of the medium feeding device according to the first exemplary embodiment.

In this example, for example, as FIG. 4 illustrates, the upper drawer 13 has a storage portion 30 as a storage unit that stores media as a form of a sheet, a delivery roller 40 as a delivery unit that is disposed downstream in the medium delivery direction relative to the media stored in the storage portion 30 and that delivers the media individually, a vacuum head 50 as a transfer unit that is disposed above the storage portion 30 and that adheres by suction to each of the media stored in the storage portion 30 and transfers the media to the delivery roller 40, and a fluffing mechanism 70 as a fluffing unit that is disposed beside the media stored in the storage portion 30 in a direction intersecting the medium delivery direction. The fluffing mechanism 70 fluffs an upper-side region of the media in a state of being separated, by blowing air toward a side of the media. The upper drawer 13 further has an air separation mechanism 80 that is provided, in the media delivery direction, downstream of the media that are stored in the storage portion 30 and that blows air toward a region between the upper-side medium that has been fluffed by the fluffing mechanism 70 and a medium below the upper-side medium to cause the fluffed medium to be separated from the other media.

Storage Portion

Figure 5:
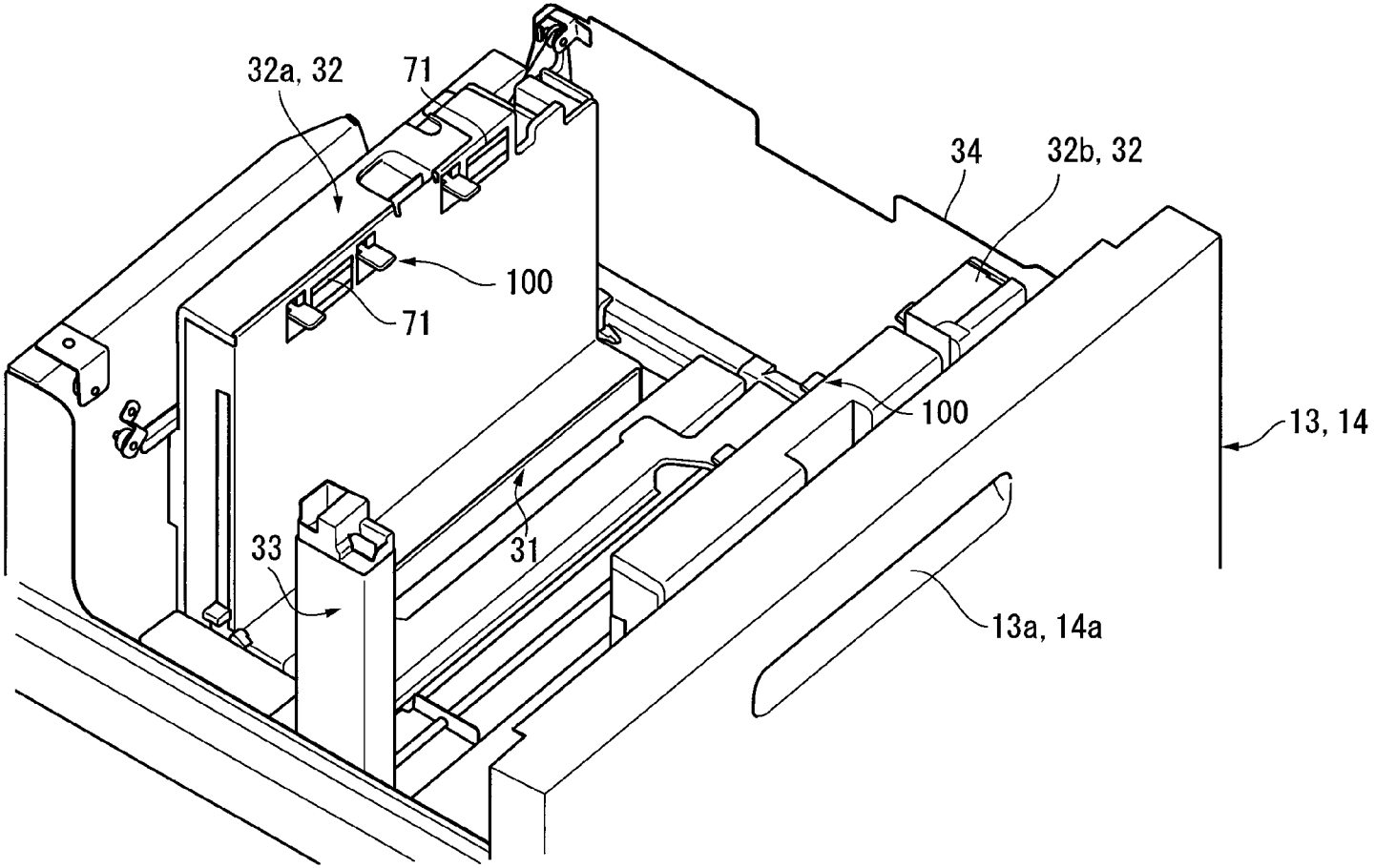
FIG. 5 is a perspective view illustrating a configuration example of a medium storage portion of the medium feeding device according to the first exemplary embodiment.

In this example, as FIGS. 4 and 5 illustrate, the storage portion 30 includes a stacking bottom plate 31 on which media of a variety of sizes are to be stacked. The storage portion 30 further includes: in the width direction intersecting the delivery direction of the media that have a variety of sizes and that are stacked on the stacking bottom plate 31, side guides 32 (specifically, 32*a* and 32*b*) as side guide units that are provided on the sides of the media and that guide the media for positioning the sides of the media; an end guide 33 as a rear guide unit that is disposed on the rear side of the media, which are stacked on the stacking bottom plate 31, upstream in the medium delivery direction and that guides the media for positioning the rear side of the media; and a partition plate 34 that serves as a partition and defines a position of the media, which are stacked on the stacking bottom plate 31, on the downstream side in the medium delivery direction.

In this example, the storage portion 30 may be designed in accordance with the size of a medium to be used, and the medium to be used may be an ordinary-size medium in view of providing versatility. For the ordinary-size medium here, for example, a medium having a length of up to 488 mm in the longitudinal direction may be used, and an example of the medium in such a size is a medium in a size of A3, defined by the Japanese Industrial Standards (JIS), or smaller.

In this example, the side guides 32 are provided so as to move in the width direction of the stacking bottom plate 31 and are to be positioned at predetermined positioning positions. The end guide 33 is provided so as to move forward and backward in the delivery direction of media on the stacking bottom plate 31 and is to be positioned at predetermined positioning positions. In this example, the partition plate 34 has plural stopper pieces 35 (refer to FIG. 8 and, in this example, two pieces are provided) that each protrude upward from the upper edge of the partition plate 34. The stopper pieces 35 function as a stopper wall 36 by which an upper region of media when the fluffing mechanism 70 is not used is retained.

In addition, as FIG. 4 illustrates, the stacking bottom plate 31 is supported by a raising/lowering mechanism 90 (refer to FIG. 10), which will be described below, so as to be raised and lowered.

Delivery Roller

Figure 8:
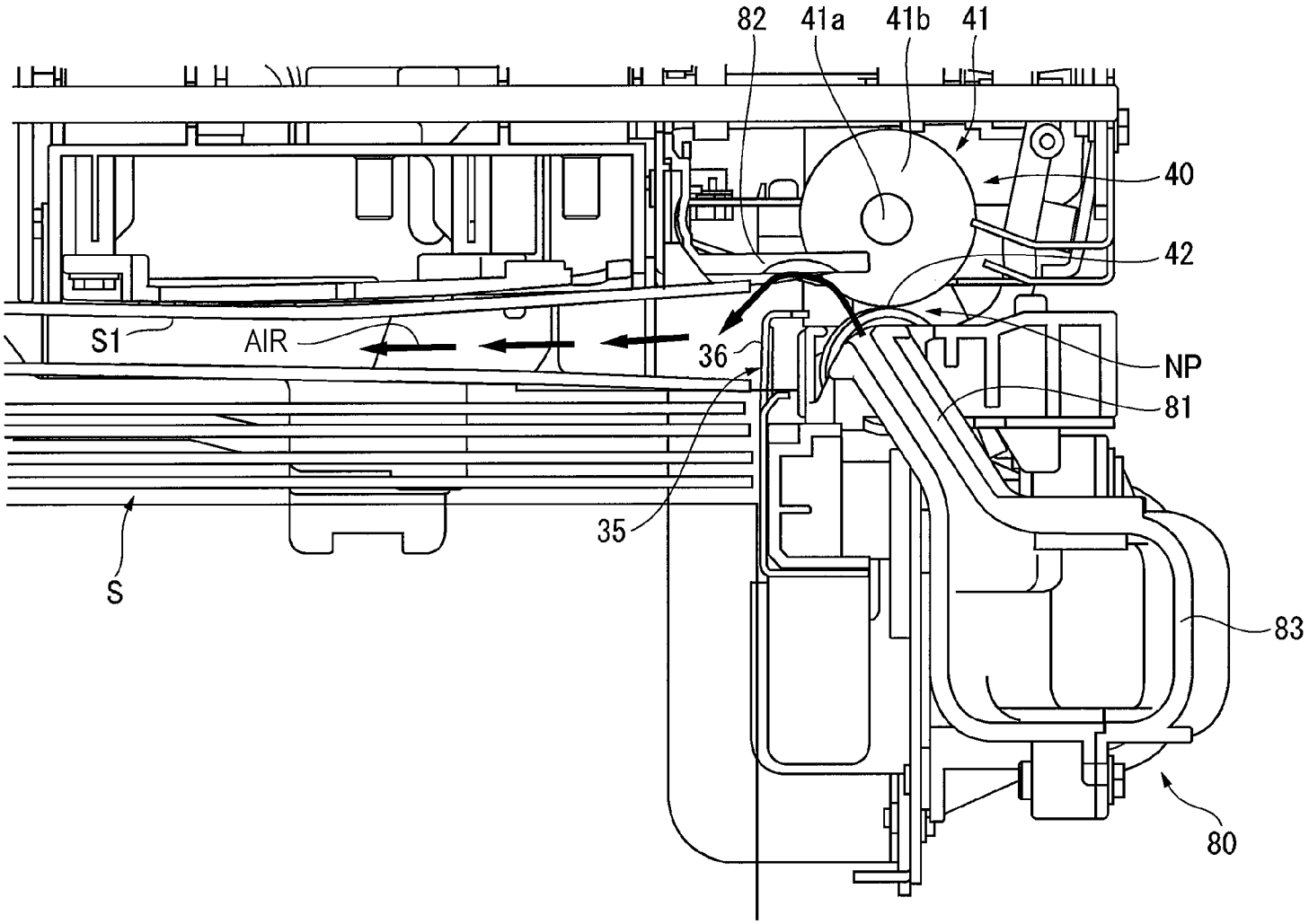
FIG. 8 illustrates a configuration example of an air separation mechanism in FIG. 4.

In this example, as FIGS. 4 and 8 illustrate, the delivery roller 40 has a driving roller 41 including a drive shaft 41*a* that performs rotatable driving and plural divided roller bodies 41*b* and 41*c* around the drive shaft 41*a*, and has a driven roller 42 that is rotatably driven by following the rotation of the driving roller 41 and that includes a rotation shaft 42*a* and plural divided roller bodies 42*b* and 42*c* around the rotation shaft 42*a*. The delivery roller 40 transports a medium by nipping the medium at contact portions NP of the driving roller 41 and the driven roller (specifically, corresponding to a nip region between the divided roller bodies 41*b* and 42*b* and a nip region between the divided roller bodies 41*c* and 42*c*).

When being denoted collectively, the divided roller bodies 41*b* and 42*b* are referred to as a "divided roller 43". When being denoted collectively, the divided roller bodies 41*c* and 42*c* are referred to as a "divided roller 44".

Vacuum Head

Figure 6:
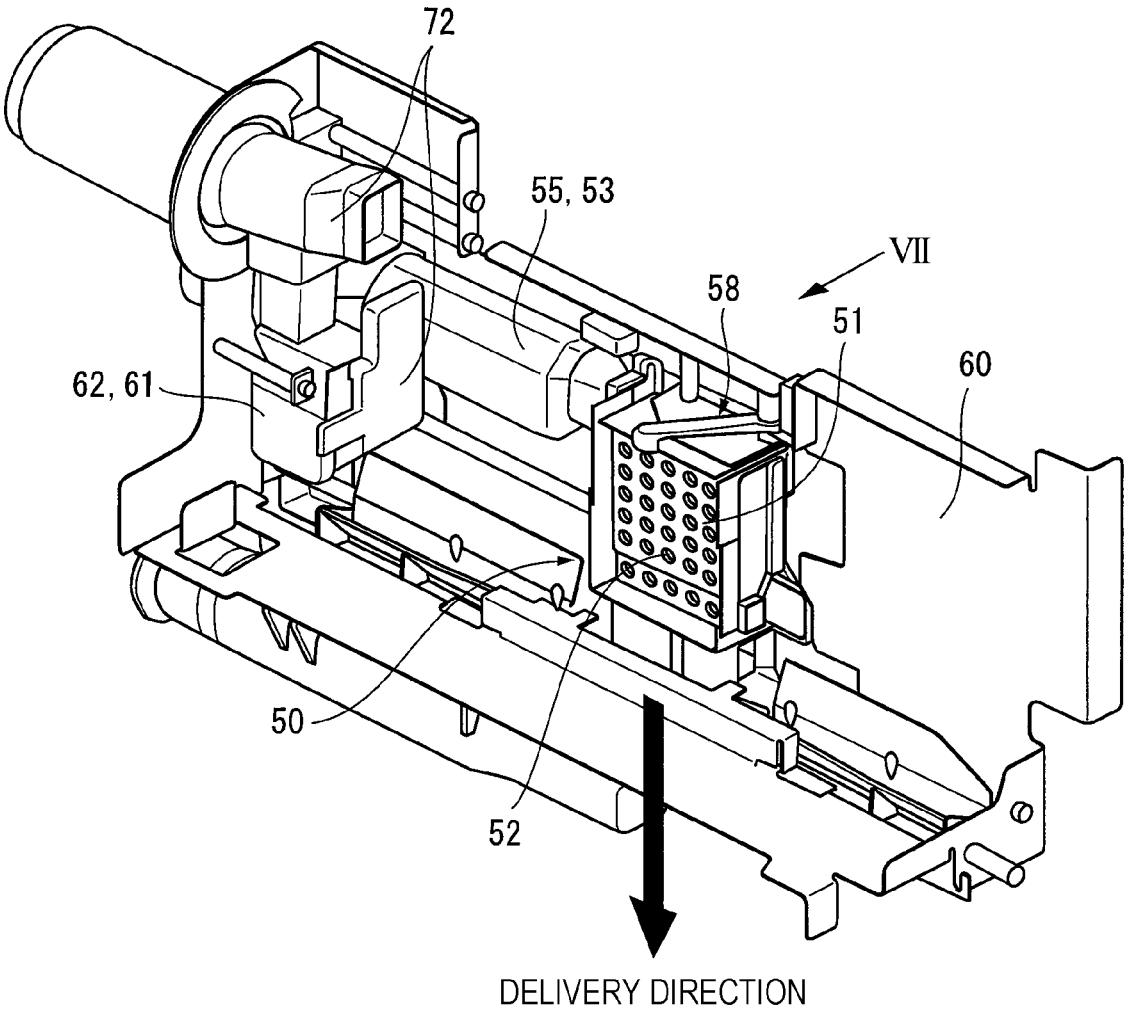
FIG. 6 illustrates the details of a vacuum head, as a transfer unit, according to the first exemplary embodiment.
Figure 7:
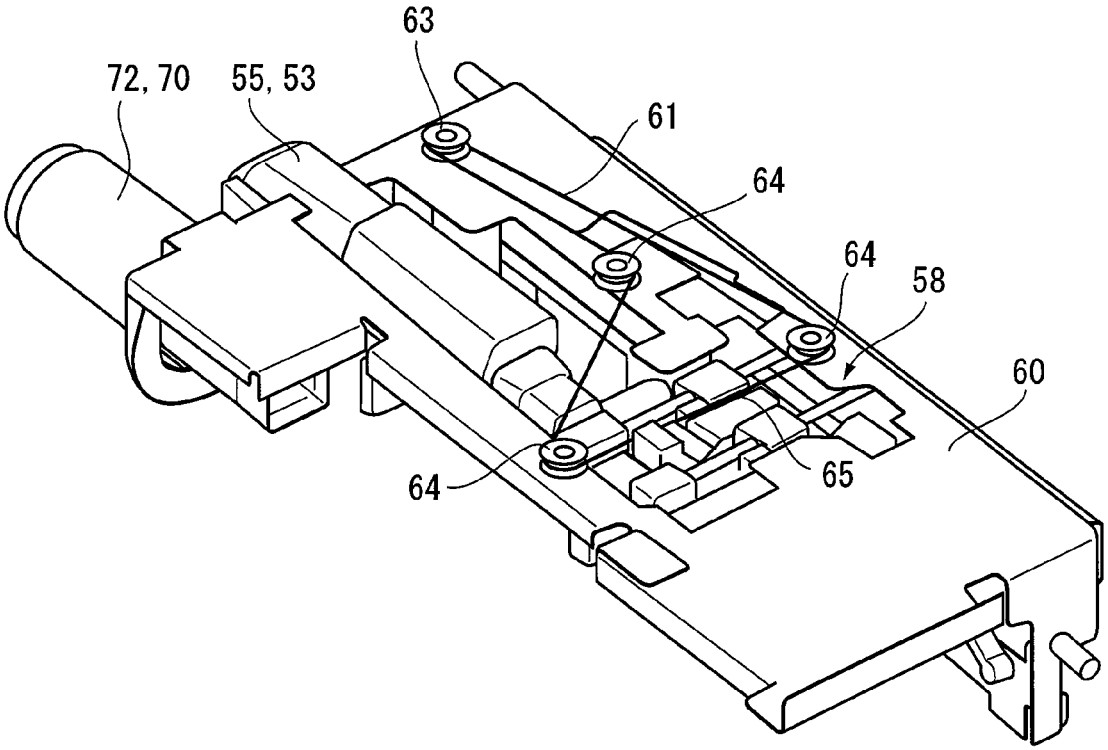
FIG. 7 illustrates the vacuum head in FIG. 6 as viewed in direction VII in FIG. 6.
Figure 9A:
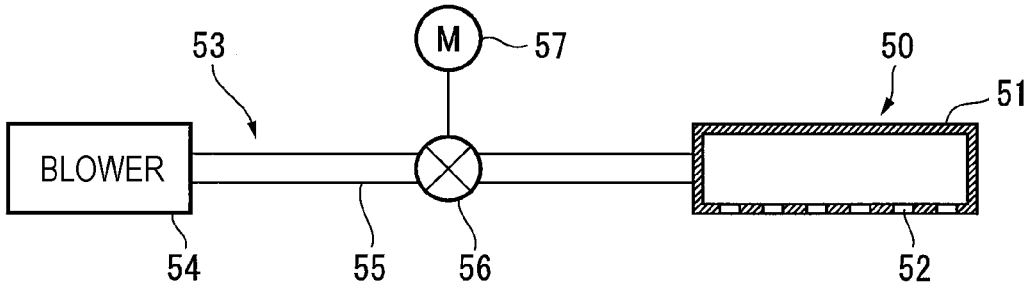
FIG. 9A illustrates a configuration example of a suction mechanism for the vacuum head in FIG. 4.

In this example, as FIGS. 6, 7, and 9A illustrate, the vacuum head 50 is supported by a head frame 60, which is fixed to the housing 12 at a position above the storage portion 30, by using a guide mechanism 58 (for example, a guide rod is used), and the vacuum head 50 is provided so as to advance and retreat in the medium delivery direction.

In this example, the vacuum head 50 has a head body 51 having a hollow boxy shape. A surface of the head body 51 facing media stored in the storage portion 30 has a large number of vacuum holes 52, and a suction mechanism 53 is connected to the head body 51. The suction mechanism 53 here adopts a configuration in which a blower 54 for suction and the head body 51 are coupled to one another by a vacuum duct 55, in the middle of which, a vacuum valve 56 that opens and closes a flow passage is interposed, and the vacuum valve 56 is opened and closed by a valve motor 57.

The head frame 60 has an advancing/retreating mechanism 61 that causes the vacuum head 50 to advance and retreat. In this example, as FIGS. 6 and 7 illustrate, the advancing/retreating mechanism 61 has a configuration in which a stepping motor 62 is fixed to the head frame 60, a driving pulley 63 is coupled to the stepping motor 62, the head frame 60 further has the appropriate number of transmission pulleys 64 at appropriate locations, a wire 65 is looped over each of the driving pulley 63 and the transmission pulleys 64, and a portion of the wire 65 is anchored to the vacuum head 50. In this example, the driving pulley 63 rotates in accordance with the rotation of the stepping motor 62 in the forward and reverse directions. With the rotation of the driving pulley 63, the wire 65 moves by a predetermined amount, and the vacuum head 50 thus advances and retreats in the medium delivery direction.

Fluffing Mechanism

Figure 9B:
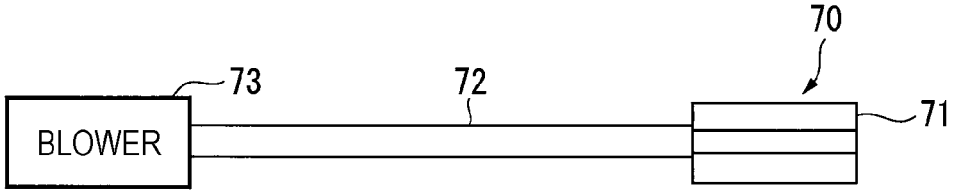
FIG. 9B illustrates a configuration example of a fluffing mechanism in FIG. 4.

In this example, as FIGS. 4, 5, and 9B illustrate, the fluffing mechanism 70 has a configuration in which, for example, each of the side guides 32 (32*a* and 32*b*) has a hollow boxy shape, plural air blowing ports 71 are formed in an upper portion of the side guide 32 facing a side of media, an air duct 72 is provided in a hollow of the side guide 32, one end of the air duct 72 is in communication with the corresponding air blowing port 71, and the other end of the air duct 72 is in communication with a blower 73 that is for blowing. The blower 73 may be built into the side guide 32 or attached externally to the side guide 32.

In addition, in this example, a medium regulating portion 100 is provided near the corresponding air blowing port 71 of the side guide 32. Each medium regulating portion 100 is provided beside media stacked on the stacking bottom plate 31 and protrudes into a media storage region so as to regulate an excessive amount of fluffing of a medium that is fluffed when the fluffing mechanism 70 is used.

Air Separation Mechanism

Figure 9C:
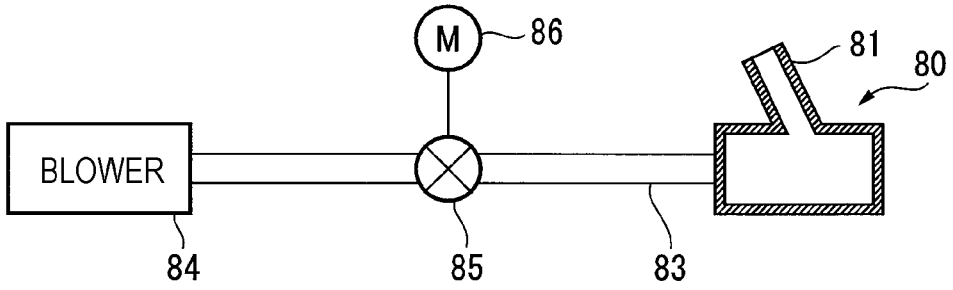
FIG. 9C illustrates an example of an air supply system for the air separation mechanism in FIG. 4.

In this example, as FIGS. 4, 8, and 9C illustrate, the air separation mechanism 80 has an air nozzle 81 that blows knife-shaped air backward and diagonally upward from the lower side toward a downstream end portion, in the delivery direction, of a medium that is fluffed by the fluffing mechanism 70. The air separation mechanism 80 causes the air that has been blown from the air nozzle 81 to change direction by using an air guide plate 82 and blows the air into a region between an upper-side medium that has been fluffed by the fluffing mechanism 70 and media below the upper-side medium to separate the medium from the other media.

In this example, an air duct 83 is in communication with the air nozzle 81, and a blower 84 for blowing air is connected to the air duct 83. An opening/closing valve 85 that opens and closes a flow passage is provided in the middle of the air duct 83 and opened and closed by using a valve motor 86.

Raising/Lowering Mechanism

Figure 10A:
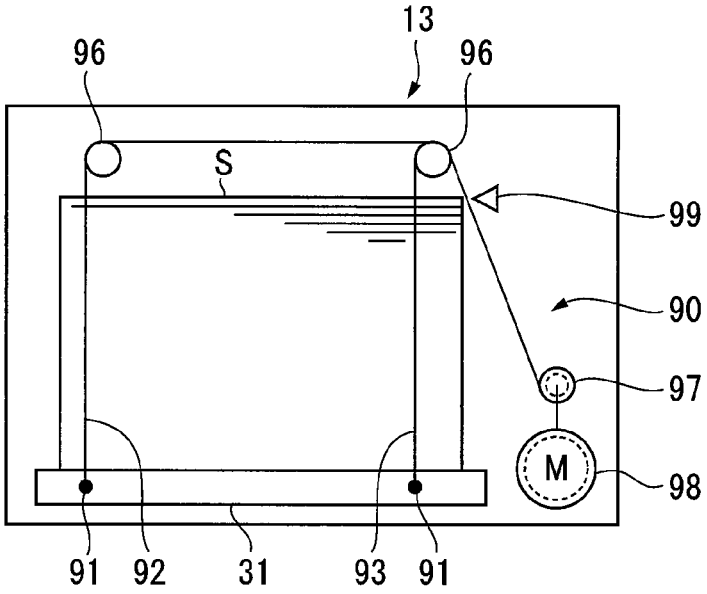
FIG. 10A illustrates a configuration example of a raising/lowering mechanism in FIG. 4.
Figure 10B:
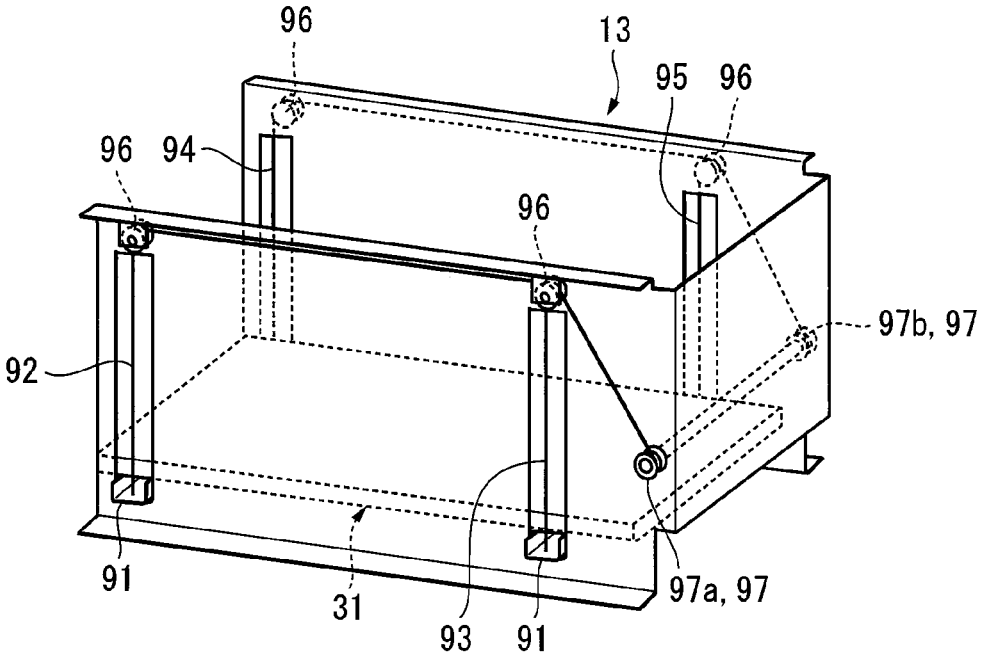
FIG. 10B is a partial perspective view of the raising/lowering mechanism in FIG. 10A.

As FIGS. 4, 10A, and 10B illustrate, in the raising/lowering mechanism 90, suspending portions 91 are provided at four locations on both sides of the stacking bottom plate 31 in the width direction intersecting the medium delivery direction. Four wires 92, 93, 94, and 95 are provided so that an end of each of the wires 92 to 95 is coupled to the corresponding suspending portion 91. Each of the wires 92 to 95 is looped over one or plural guide pulleys 96, and the other side end of each of the wires 92 to 95 is anchored to a corresponding pulley of winding pulleys 97 (in this example, 97*a* and 97*b*) that are coupled to one another by a common shaft. The raising/lowering mechanism 90 raises and lowers the stacking bottom plate 31 while the stacking bottom plate 31 maintaining the parallel orientation by each of the wires 92 to 95 moving by a predetermined amount due to the winding pulleys 97 being rotated by a driving motor 98 that is capable of rotating in the forward and reverse directions. Reference 99 denotes a height sensor for setting a surface of the media stacked on the stacking bottom plate 31 to a predetermined height position.

Position Sensors

In the present exemplary embodiment, as FIG. 4 illustrates, across the delivery roller 40 in the medium delivery direction, prior stage position sensors 120 are arranged upstream, and a later stage position sensor 130 is arranged downstream.

The plural prior stage position sensors 120 (in this example, two: specifically, 120*a* and 120*b*) are arranged at locations in a region that is on the delivery roller 40 side relative to a downstream end portion, in the delivery direction, of a medium stored in the storage portion 30 and that does not reach the nip regions NP of the delivery roller 40.

The prior stage position sensors 120 are arranged in the width direction intersecting the medium delivery direction, that is, in the axial direction of the delivery roller 40, at an interval and detect a position of the downstream end portion of the medium in the medium delivery direction. Thus, the prior stage position sensors 120 are used to provide information for determining, other than whether the medium has passed, the extent of a skew state of the medium.

On the other hand, the single later stage position sensor 130 that detects that a medium has passed through the nip regions NP of the delivery roller 40 is disposed at a position within a passing region of media.

Each of the prior stage position sensors 120 has, for example, a sensor housing in which a light-emitting element that radiates light toward a medium that is delivered and a light-receiving element that receives reflected light by the medium are arranged side by side. The prior stage position sensors 120 are capable of detecting that a downstream end portion, in the delivery direction, of the medium passes the prior stage position sensors 120, at the timing when the light-receiving elements receive light. The later stage position sensor 130 has a configuration substantially similar to the prior stage position sensor 120.

Control System

In this example, as FIG. 4 illustrates, a controller 200 that controls the medium feeding device 11 is provided. The controller 200 is constituted by a microcomputer including, for example, a central processing unit (CPU), a read-only memory (ROM), a random-access memory (RAM), and an input/output (I/O) port. The controller 200 causes the CPU to take in various kinds of information associated with, for example, job designation and to take in signals received from various sensors (for example, the prior stage position sensors 120 and the later stage position sensor 130), calculates following the program that has been installed in the ROM in advance, and transmits predetermined control signals to the respective control targets.

In this example, the control targets include, for example, the delivery roller 40, the vacuum head 50 (the suction mechanism 53 and the advancing/retreating mechanism 61), the fluffing mechanism 70, the air separation mechanism 80, and the raising/lowering mechanism 90. The controller 200 also has a display 210 that displays, for example, the progress of a medium feeding job and an abnormality warning regarding a feeding state of a medium.

Process of Medium Feeding Operation

Here, assume that a medium feeding job instruction for feeding plural media has been provided.

In such a case, as FIG. 4 illustrates, in the medium feeding device 11, the controller 200 controls, for example, the delivery roller 40, the vacuum head 50, the fluffing mechanism 70, and the air separation mechanism 80 and feeds media S in the storage portion 30 in succession.

Figure 11:
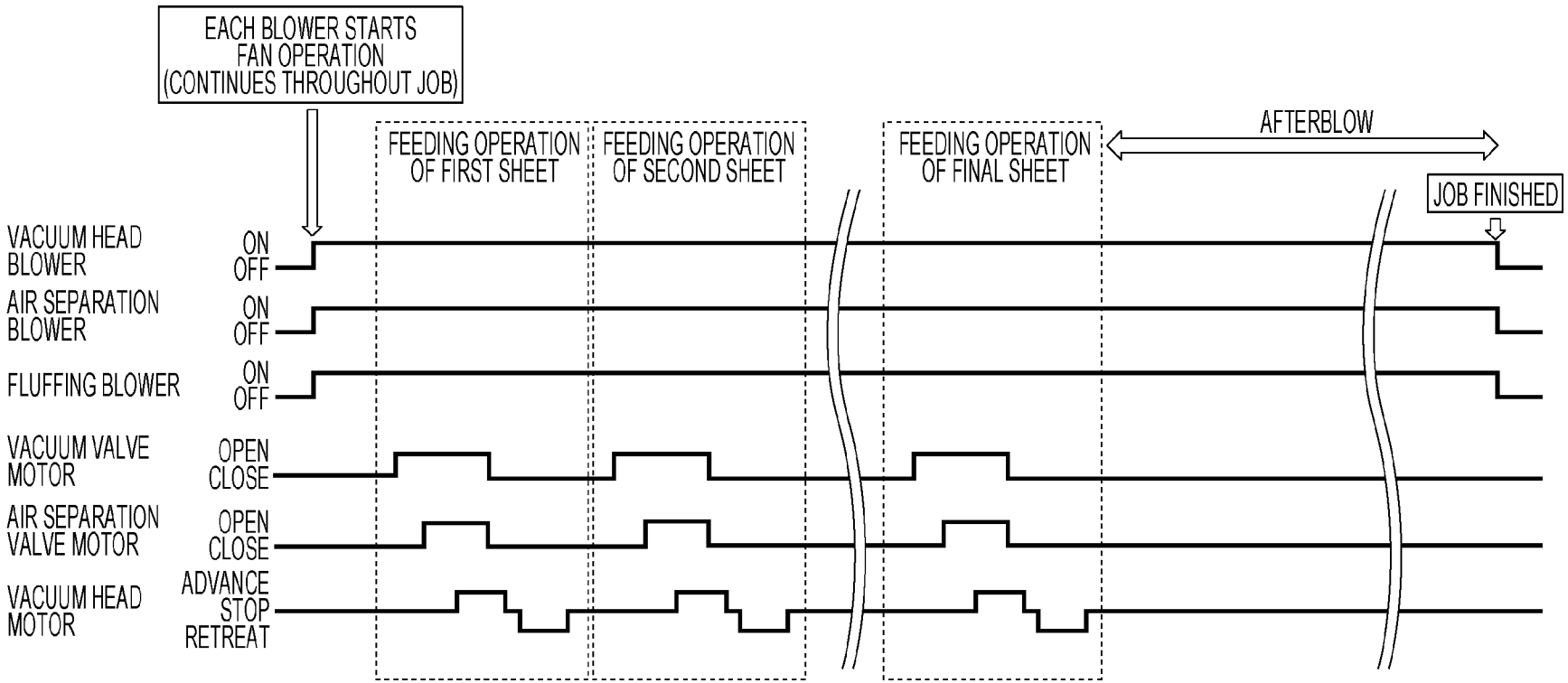
FIG. 11 is a timing chart illustrating a process of a medium feeding job.

FIG. 11 illustrates a timing chart of each related part at this time.

In FIG. 11, a "vacuum head blower" corresponds to the "blower 54" in FIG. 9A, an "air separation blower" corresponds to the "blower 84" of the air separation mechanism 80, and a "fluffing blower" corresponds to the "blower 73" of the fluffing mechanism 70.

In addition, a "vacuum valve motor" corresponds to the valve motor 57, an "air separation valve motor" corresponds to the valve motor 86, and a "vacuum head motor" corresponds to the stepping motor 62 of the advancing/retreating mechanism 61.

In this example, during the feeding job of media, the "vacuum head blower", the "air separation blower", and the fluffing blower" are in a turned-ON state throughout the feeding job. The "vacuum valve motor", the "air separation valve motor", and the "vacuum head motor" are controlled to be turned ON and OFF repeatedly each time a media sheet is fed, and the vacuum head 50A repeatedly performs a suction operation and an advancing/retreating operation and the air separation mechanism 80 repeatedly performs an operation of supplying air for media separation and an operation of stopping.

Note that the "fluffing blower" remains ON during the feeding job of the media and during the post-feeding period after the feeding job, and a so-called afterblow (an air blowing operation performed by the fluffing mechanism 70 during the post-feeding period) is performed.

Technical Challenge of Afterblow

Figure 12:
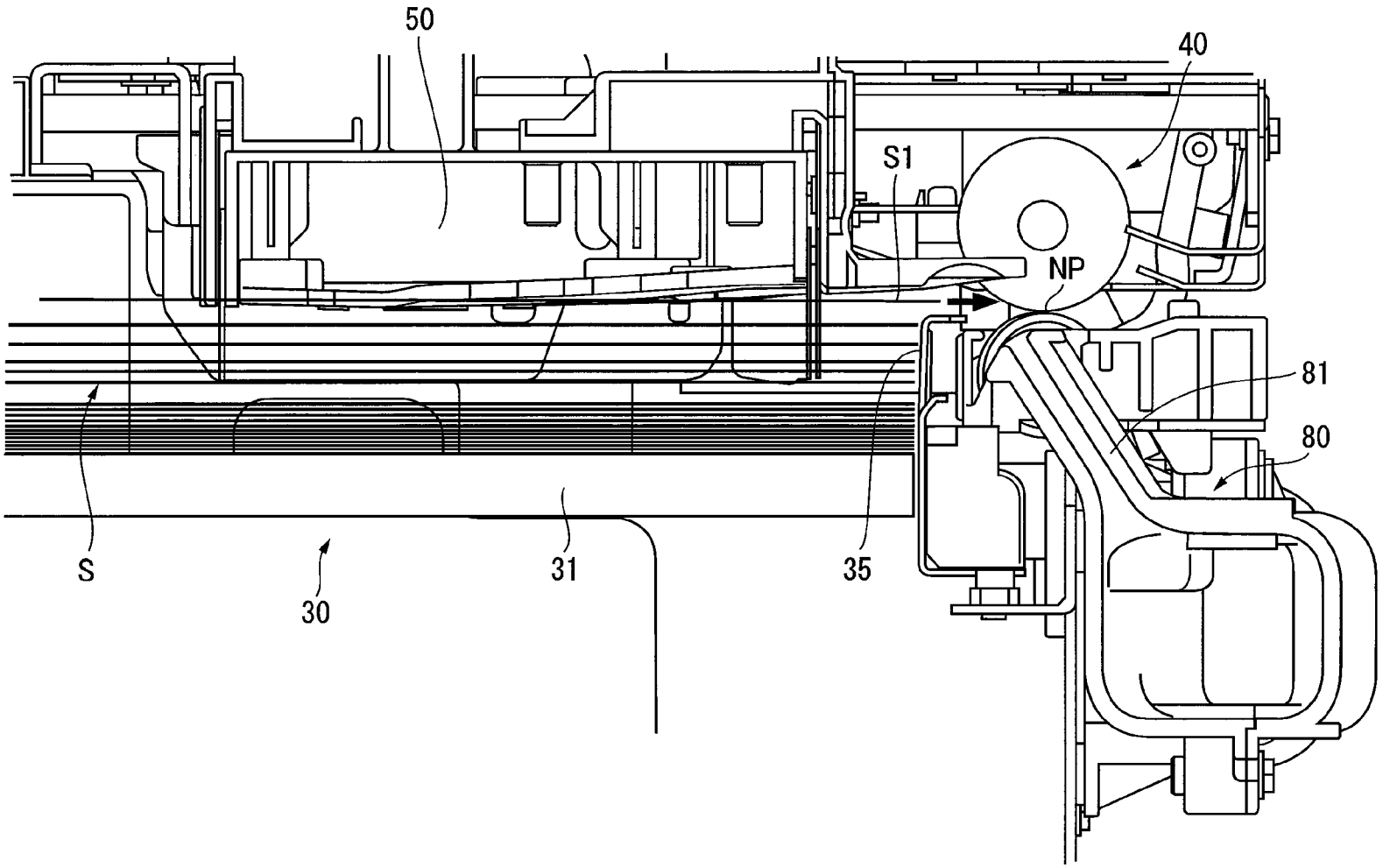
FIG. 12 illustrates a technical challenge arising during an afterblow performed by the fluffing mechanism.

Regarding the air blowing operation (corresponding to the "afterblow") during the predetermined post-feeding period, a force to blow the media upward is constantly applied. Thus, there is a concern that, as FIG. 12 illustrates, a fluffed medium may move toward the delivery roller 40 side during the post-feeding period. When an instruction for a feeding job of the next medium is provided in such a state, the feeding accuracy of the medium is decreased.

In this example, such a negative effect of the afterblow is addressed, and the following four examples, first to fourth, of the suppression mechanism are proposed.

First Example of Suppression Mechanism

Figure 13:
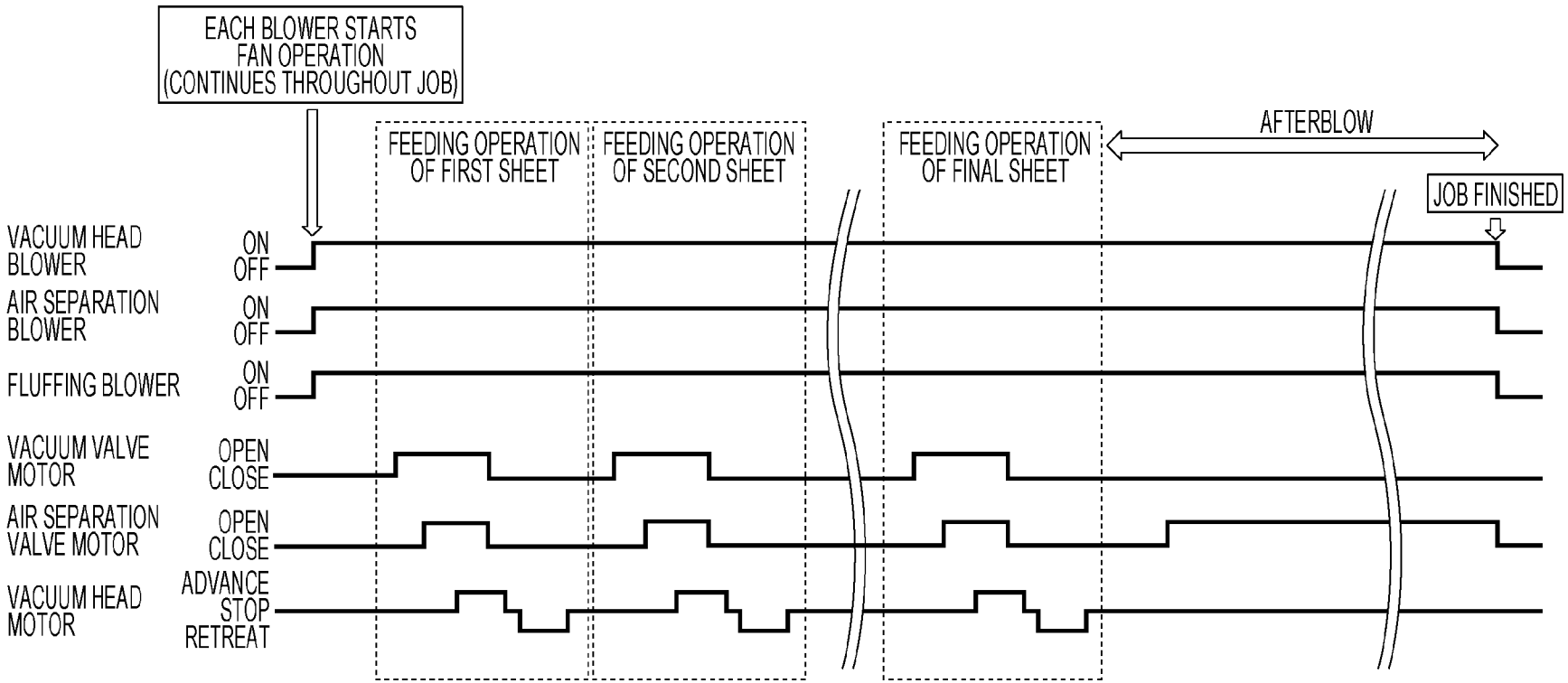
FIG. 13 illustrates a first example of a suppression mechanism used in the first exemplary embodiment, during air blowing in a post-feeding period.

FIG. 13 illustrates the operation timing of a first example of the suppression mechanism.

In this example, during the post-feeding period, a medium is suppressed from advancing toward the delivery roller 40 side by using the existing air separation mechanism 80.

Figure 14:
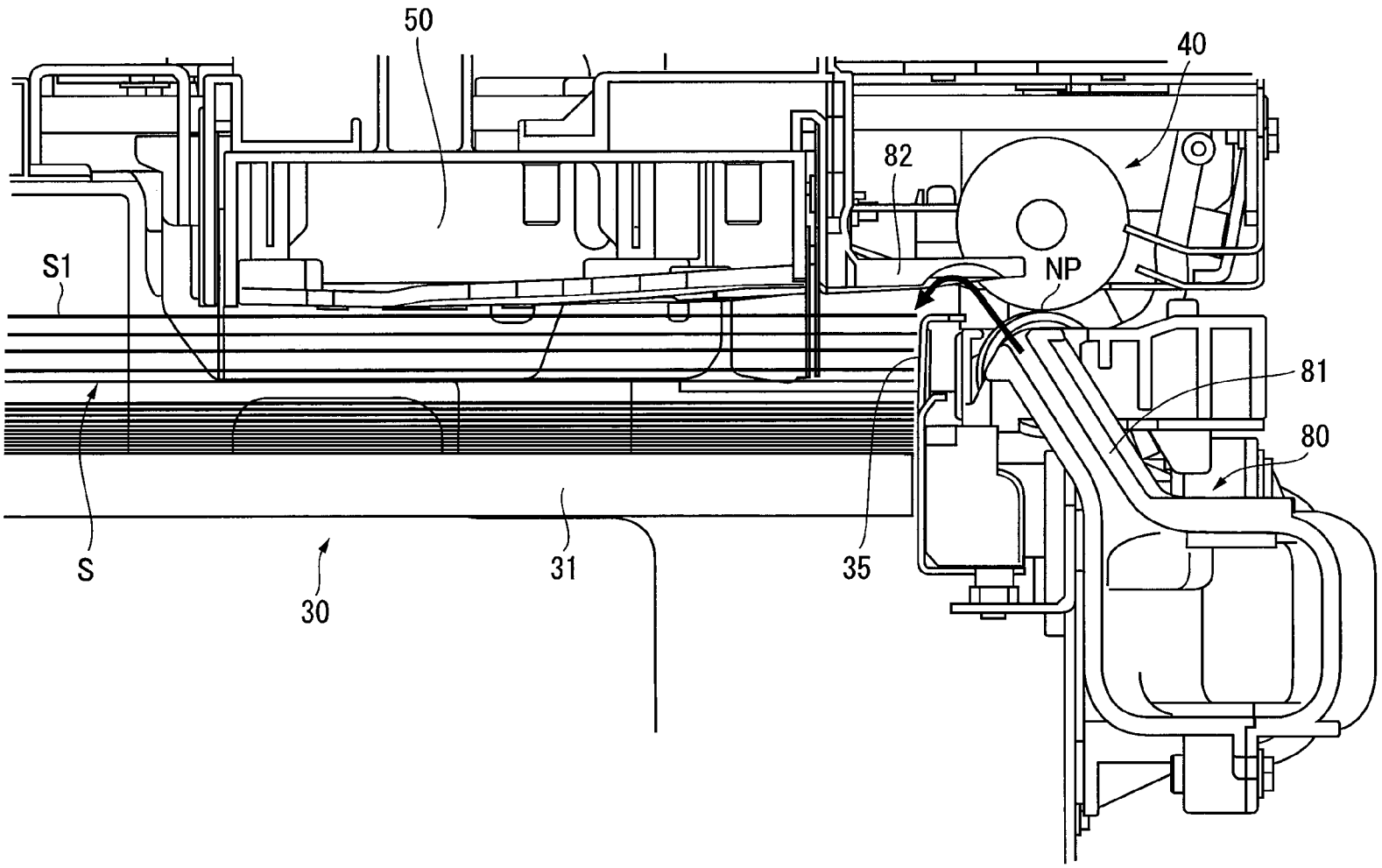
FIG. 14 illustrates schematically an operation performed by the first example of the suppression mechanism in FIG. 13.

Specifically, during the afterblow, as FIG. 14 illustrates, the air separation mechanism 80 is caused to blow air by the air separation valve motor driving.

In this example, as FIG. 14 illustrates, a fluffed medium S1 receives knife-shaped air from the air nozzle 81 of the air separation mechanism 80, and a downstream end portion of the medium in the delivery direction is pushed to a position lower than the tip position of each stopper piece 35. Thus, the fluffed medium is suppressed from advancing toward the delivery roller 40 side.

Second Example of Suppression Mechanism

Figure 15:
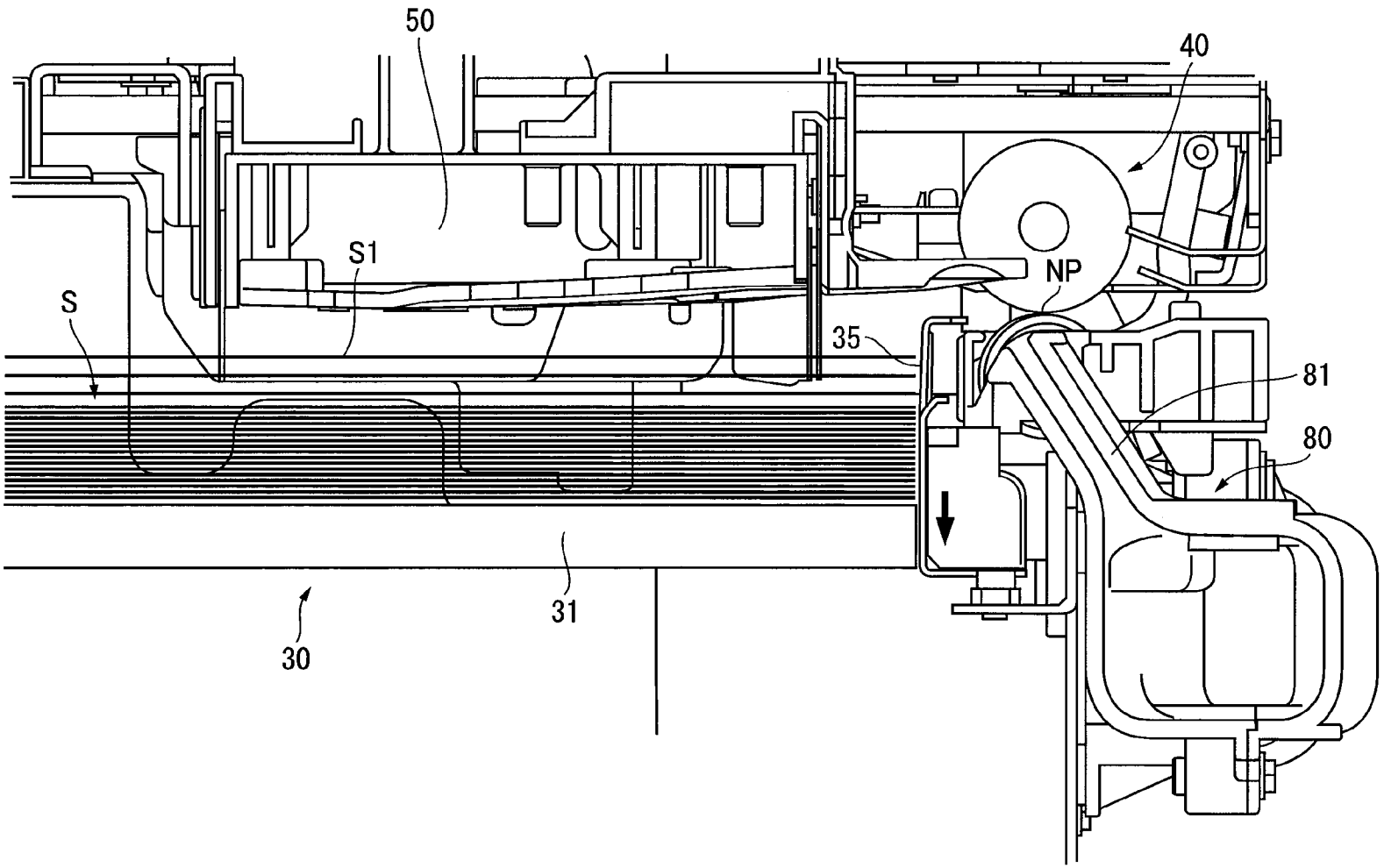
FIG. 15 illustrates a second example of the suppression mechanism used in the first exemplary embodiment, during the air blowing in the post-feeding period.

As FIG. 15 illustrates, this example utilizes the raising/lowering mechanism 90 of the stacking bottom plate 31. The stacking bottom plate 31 is lowered by the raising/lowering mechanism 90 of the stacking bottom plate 31 during the post-feeding period.

The lowering amount at this time may be selected so that a fluffed medium S1 is located at a position lower than the height of each stopper piece 35. In such a case, the fluffed medium is retained by the stopper pieces 35, and there is thus no concern that the fluffed medium may advance toward the delivery roller 40 side.

In this example, when an instruction for a feeding job of the next medium is provided, media may be raised by the raising/lowering mechanism 90 so that the surface of the media is located at a predetermined home position.

Third Example of Suppression Mechanism

Figure 16:
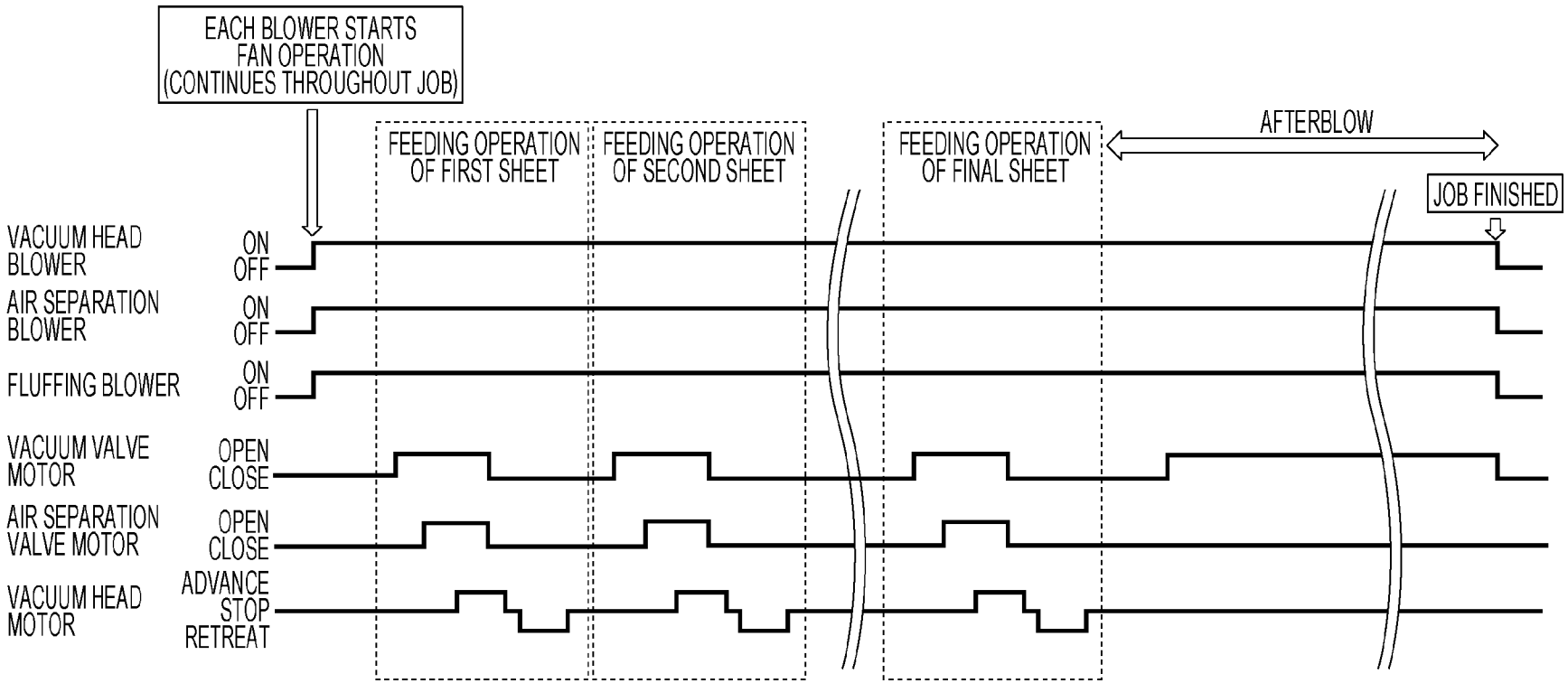
FIG. 16 illustrates schematically an operation performed by a third example of the suppression mechanism.
Figure 17:
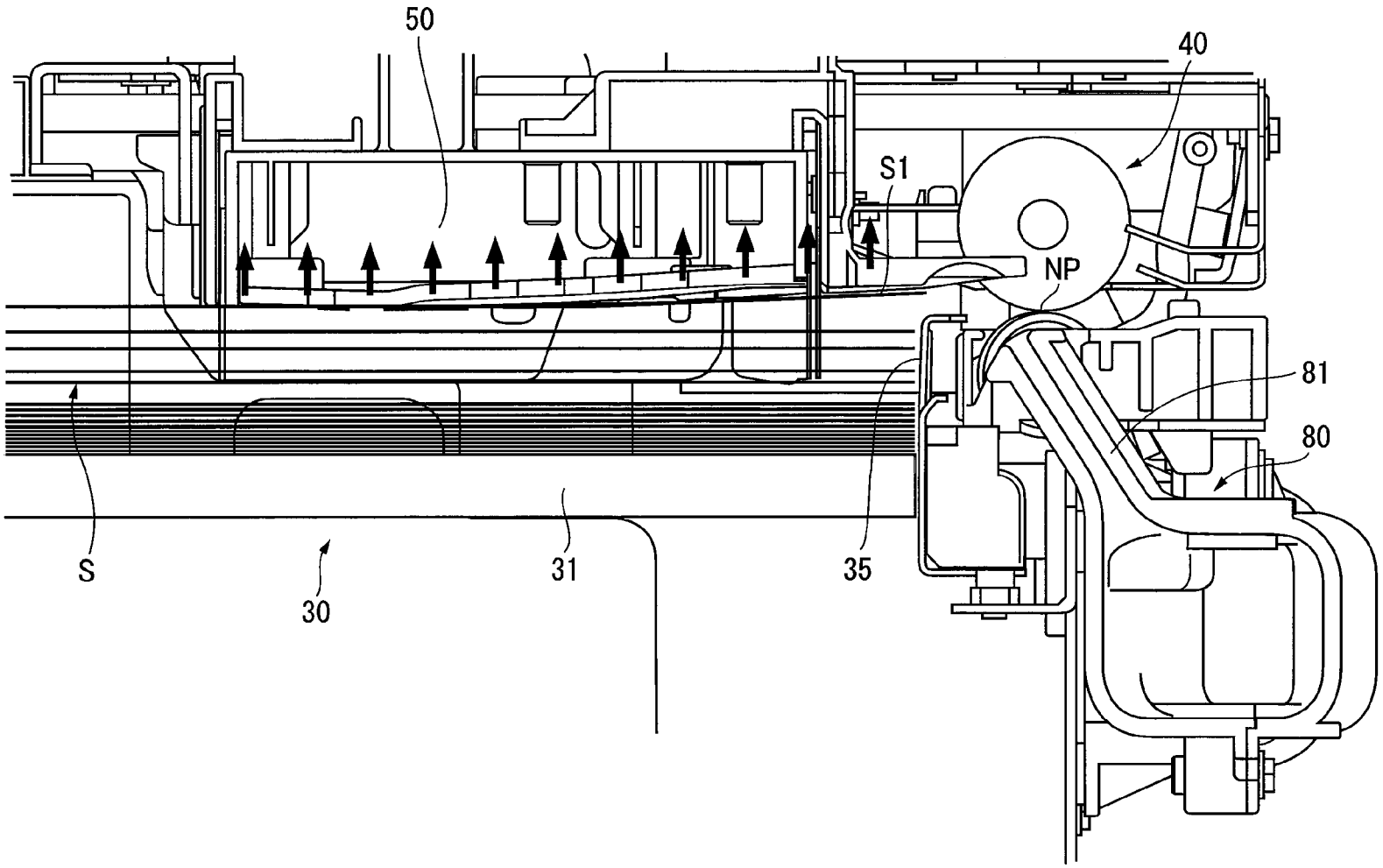
FIG. 17 illustrates the third example of the suppression mechanism used in the first exemplary embodiment, during the air blowing in the post-feeding period.

In this example, as FIGS. 16 and 17 illustrate, during the post-feeding period that is the period when the afterblow is performed, the vacuum head 50 is used in a manner such that the vacuum head 50 adheres by suction to and restrains a fluffed medium S1 by the vacuum valve motor being turned ON.

In this example, even when the afterblow is performed, the fluffed medium remains at a home position while being sucked by and adhering to the vacuum head 50. Thus, during the afterblow, there is no concern that the fluffed medium may advance toward the delivery roller 40 side.

Fourth Example of Suppression Mechanism

Figure 18:
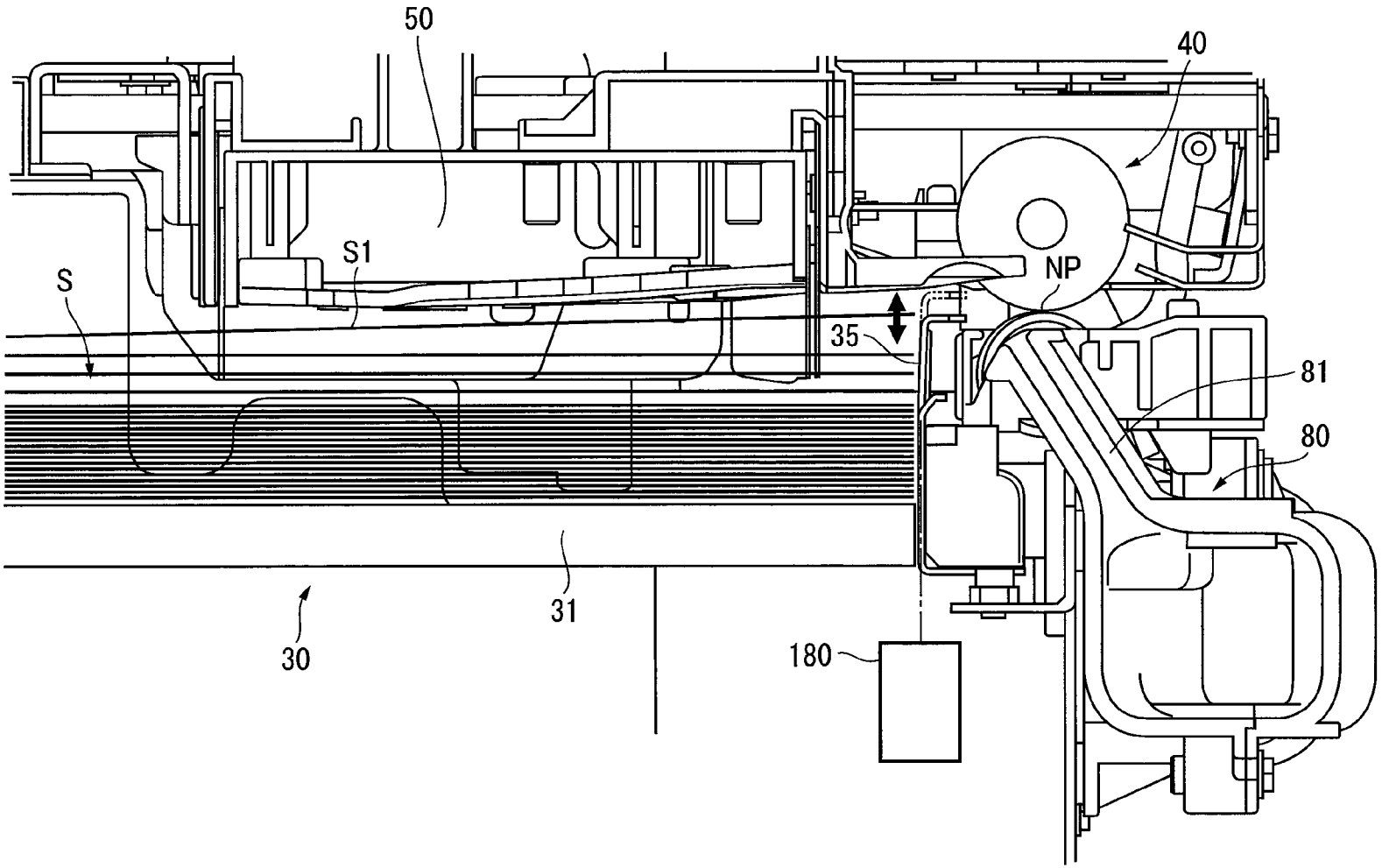
FIG. 18 illustrates a fourth example of the suppression mechanism used in the first exemplary embodiment, during the air blowing in the post-feeding period.

In this example, as FIG. 18 illustrates, the stopper pieces 35 are supported by a raising/lowering actuator 180 so as to be raised and lowered. During the post-feeding period when the afterblow is performed, the raising/lowering actuator 180 raises the stopper pieces 35 so that each stopper piece 35 is located higher than a usual height position (home position). Thus, even if a fluffed medium S1 is caused to advance toward the delivery roller 40 side during the afterblow, the raised stopper pieces 35 retain the medium.

In this example, after completion of the afterblow, the stopper pieces 35 may be lowered to the predetermined height position (home position) by the raising/lowering actuator 180.

Second Exemplary Embodiment

Figure 19:
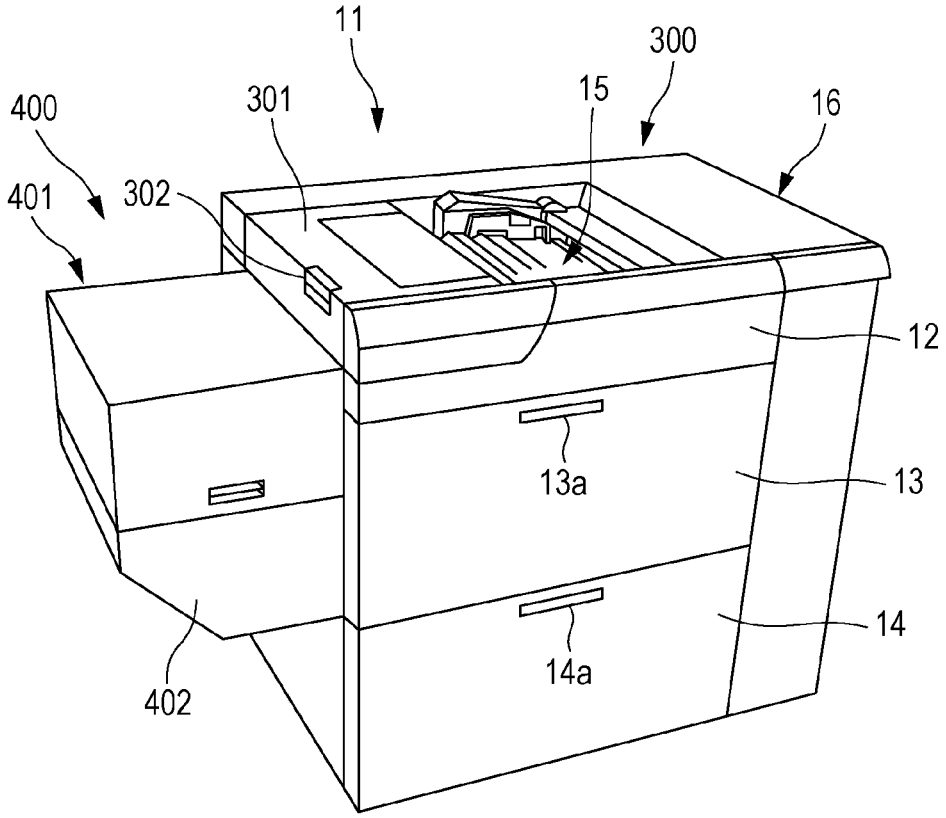
FIG. 19 is an external perspective view illustrating a related part of a medium feeding device according to a second exemplary embodiment.

FIG. 19 illustrates a related part of a medium feeding device 11 according to a second exemplary embodiment.

In FIG. 19, the basic configuration of the medium feeding device 11 is substantially similar to that of the first exemplary embodiment. Unlike the first exemplary embodiment, it is possible to use, in addition to normal-size media, long media whose length in the longitudinal direction is greater than that of the normal-size media. Constituents similar to those of the first exemplary embodiment are given by references similar to those given in the first exemplary embodiment, and the detailed description of such constituents will be omitted.

In this example, the medium feeding device 11 has a body portion 300 (having a configuration substantially similar to the medium feeding device of the first exemplary embodiment) that is stacked with and feeds normal-size media. By a long size option 400 being added to the body portion 300, it is possible for the medium feeding device 11 to be stacked with and feed the long media.

In this example, the body portion 300 has a configuration substantially similar to that of the medium feeding device 11 of the first exemplary embodiment. Unlike the first exemplary embodiment, in the body portion 300, an opening to which the long size option 400 is connectable is ensured in a side wall of a housing 12 on a side facing away from the relay unit 16. In addition, at a location that is in an upper portion of the housing 12 and adjacent to the manual feeding portion 15, an opening/closing covering part 301 is provided. The opening/closing covering part 301 is opened and closed with a portion thereof on the manual feeding portion 15 side as a rotation supporting point. In the body portion 300, by operating a handle 302 provided on the opening/closing covering part 301, the opening/closing covering part 301 is opened to ensure a working space when a long medium is set.

Figure 20:
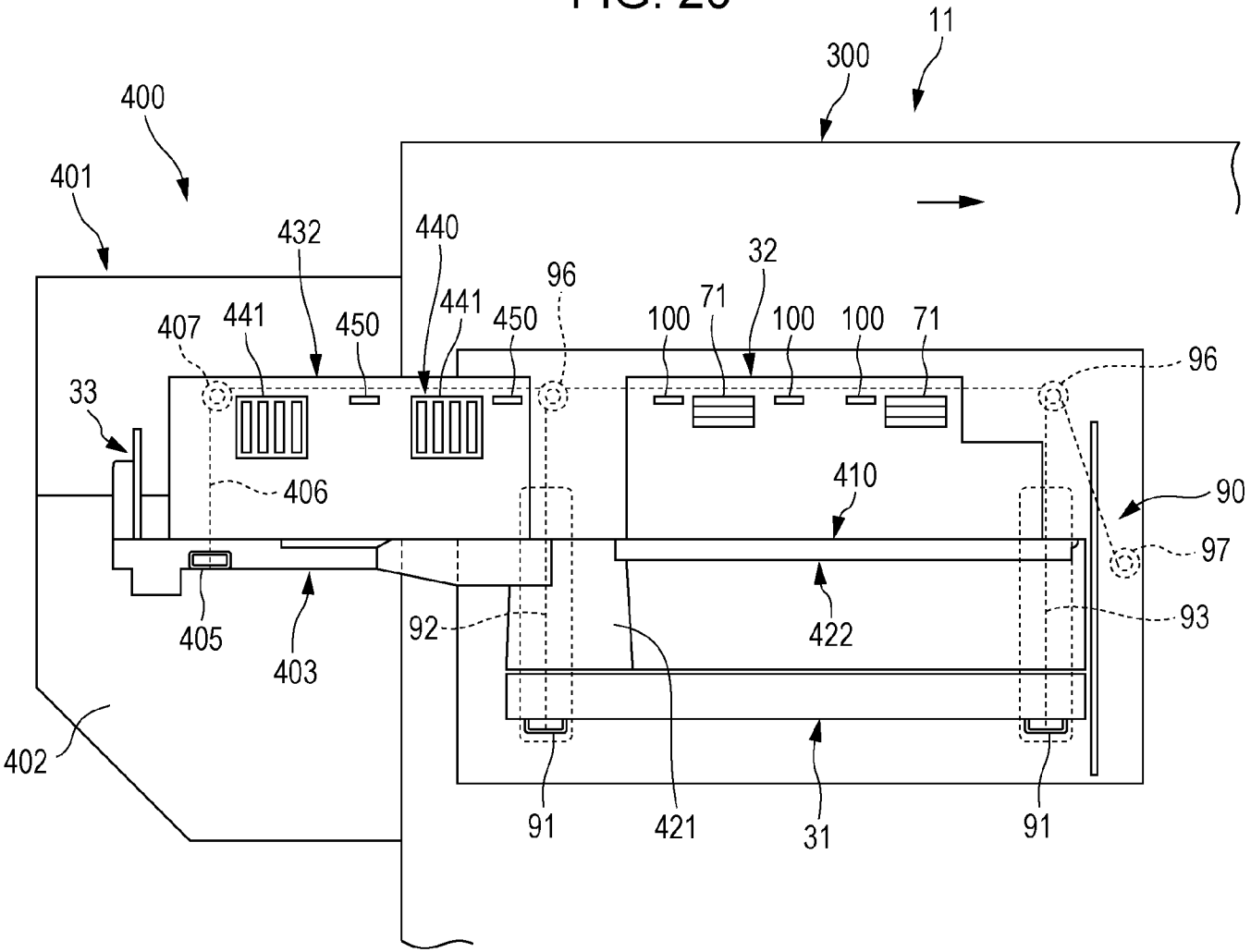
FIG. 20 is a front view of a related part of the inner structure of the medium feeding device in FIG. 19.
Figure 21:
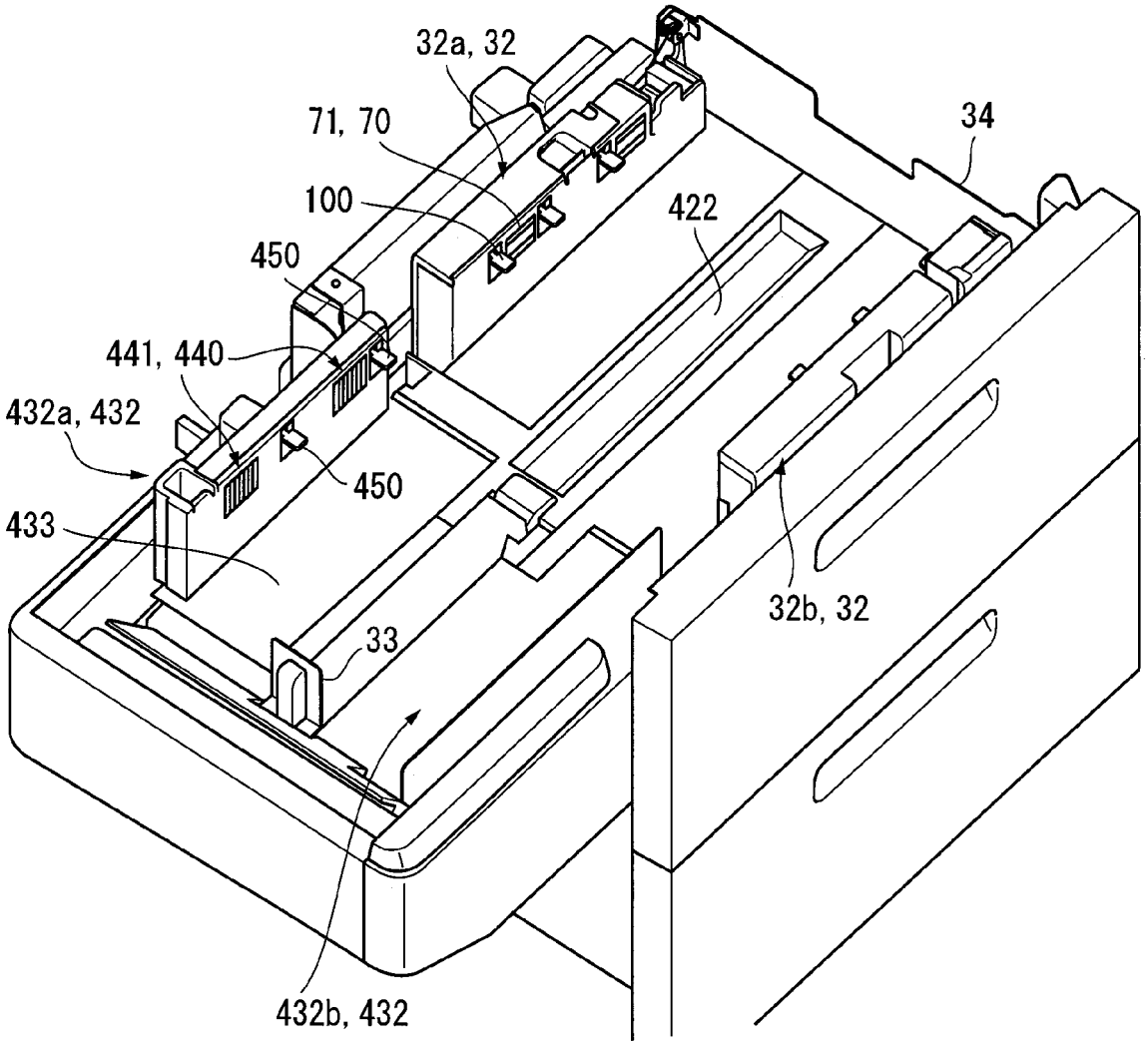
FIG. 21 illustrates a related part of a storage portion for long media in FIG. 20.

In this example, as FIGS. 19 to 21 illustrate, the long size option 400 includes an addition section 401 that is connected to the opening of the side wall of the body portion 300 on the side facing away from the relay unit 16 and a change section 420 that adds a change to a portion of the configuration in the body portion 300 area.

In this example, regarding the change section 420, a raising base 421 as a raising portion, which is for raising the height of the stacking bottom plate 31, that is disposed on the stacking bottom plate 31 included in the storage portion 30 of the upper drawer 13 in the body portion 300, and a surface portion of the raising base 421 is used as a specialized stacking portion 422 for long media.

Regarding the addition section 401, in an external housing 402, an additional stacking portion 403 is disposed at a location adjacent to a portion of the specialized stacking portion 422 on the side facing away from the delivery roller 40. A stacking surface of the specialized stacking portion 422 and a stacking surface of the additional stacking portion 403 are substantially flush with one another and function together as a long medium stacking portion 410 on which long media are enabled to be stacked. In this example, in particular, the stacking surface for long media is raised with respect to the stacking surface for normal-size media by using the raising base 421. This is because it is intended that the weight of the long media stacked on the long medium stacking portion 410 is decreased to reduce a load applied on a raising/lowering mechanism 90.

Moreover, in this example, the raising/lowering mechanism 90 has, in addition to the configuration for raising and lowering the stacking bottom plate 31 in the first exemplary embodiment, plural suspending portions 405, plural wires 406, and plural guide pulleys 407 all for raising and lowering the additional stacking portion 403. The wires 406 suspend and support the additional stacking portion 403. After the wires 406 are looped over the respective guide pulleys 96 that are existing constituents of the raising/lowering mechanism 90 in the body portion 300 area, one end side of each of the wires 406 is anchored to a corresponding one of the winding pulleys 97 that are existing constituents. The raising/lowering mechanism 90 raises and lowers the additional stacking portion 403 and the specialized stacking portion 422 at the same timing by the driving motor 98, which is an existing constituent, rotating.

Furthermore, inside the external housing 402 of the addition section 401, around the additional stacking portion 403, additional side guides 432 (specifically, 432*a* and 432*b*) that guide long media for positioning both sides of the long media in the width direction intersecting the delivery direction of the long media are provided. In addition, the existing end guide 33 is also used here as an end guide for the additional stacking portion 403. Moreover, in the additional side guides 432, an additional fluffing mechanism 440 is provided, and additional medium regulating portions 450 for preventing side edge portions of a long medium from being excessively fluffed when the long media are fluffed are disposed. In FIG. 22, reference 441 denotes air blowing ports of the additional fluffing mechanisms 440, and each of the additional medium regulating portions 450 is provided near the corresponding air blowing port 441.

Regarding the medium feeding device 11 in which the long size option 400 is used, long media are stored in the long medium stacking portion 410, a surface of the long media is located at a predetermined position by using the raising/lowering mechanism 90, and the medium feeding device 11 is held on standby in such a state until a medium feeding instruction is provided.

When the medium feeding instruction is provided, the medium feeding operation is performed. During the medium feeding operation, the fluffing mechanism 70 and the additional fluffing mechanism 440 operate and fluff the long media, and the vacuum head 50 adheres by suction to an upper surface portion on the downstream side, in the delivery direction, of a fluffed long medium and transports the long medium to the delivery roller 40. In addition, the air separation mechanism 80 separates a downstream end portion, in the delivery direction, of the long media one after another, and the long media are transferred to the delivery roller 40 individually.

At this time, the long media tend to be easily skewed compared with normal-size media. In this example, a state of a downstream end portion, in the delivery direction, of a long medium is detected, and whether the feeding state of the long medium is in a permissible range or in an abnormal range may be easily determined.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium feeding device comprising:

a tray that stores media in a form of a sheet;

a delivery roller that is disposed downstream in a medium delivery direction relative to the media stored in the tray and that delivers the media individually;

a suction device that is disposed above the tray and that adheres by suction to each of the media stored in the tray and transfers the media to the delivery roller;

a fluffing blower that is disposed beside the media stored in the tray in a direction intersecting the medium delivery direction, the fluffing blower fluffing an upper-side region of the media in a state of being separated, by blowing air toward a side of the media during a feeding job of the media, wherein the feeding job of the media involves feeding a media into the delivery roller; and a controller that is configured to suppress movement of the media toward a delivery roller side during air blowing performed by being configured to control the fluffing blower to blow air toward the side of the media during the feeding job of the media and continue to blow air during a post-feeding period which is a predetermined period after a completion of the feeding job of the media, wherein the tray has a stopper wall which is disposed toward a side of the delivery roller and is capable of retaining the media stored in the tray when the fluffing blower is not used, wherein the controller is further configured to lower a position of a downstream end portion, in the medium delivery direction, of a medium fluffed during the air blowing in the post-feeding period to a position within a retainable region of the stopper wall, wherein the medium feeding device further comprises an air blower which is controlled by the controller to blows air moving downward from an upper side of the tray toward the downstream end portion, in the medium delivery direction, of the medium fluffed during the air blowing in the post-feeding period, and the controller lowers the position of the downstream end portion of the medium in the medium delivery direction during the post-feeding period, and wherein the air blower which is controlled by the controller to blows air downward from the upper side of the tray toward the downstream end portion comprising:

the air blower which is controlled by the controller to blow air diagonally downward from the upper side of the tray in a direction away from the delivery roller, toward the downstream end portion of the medium in the medium delivery direction.

2. The medium feeding device according to claim 1, wherein the tray has a raising/lowering unit that raises and lowers the media, and wherein the controller is configured to lower the raising/lowering unit during the air blowing in the post-feeding period so that the fluffed medium is placed into the retainable region of the stopper wall.

3. The medium feeding device according to claim 1, wherein the controller is configured to restrain a medium fluffed during the air blowing in the post-feeding period so that the medium does not move downstream in the medium delivery direction.

4. The medium feeding device according to claim 3, wherein the controller is configured to cause the suction device to adhere by suction to the medium fluffed during the air blowing in the post-feeding period.

5. The medium feeding device according to claim 3, wherein the tray has, on the delivery roller side, a stopper wall capable of retaining the media stored in the tray when the fluffing blower is not used, and wherein the controller, during the air blowing in the post-feeding period, is configured to raise the stopper wall to retain a downstream end portion of the fluffed medium in the medium delivery direction.

6. A medium processing apparatus comprising:

the medium feeding device according to claim 1; and image forming device that performs predetermined processing on media fed from the medium feeding device.

7. A medium feeding device comprising:

storage means for storing media in a form of a sheet;

delivery means, disposed downstream in a medium delivery direction relative to the media stored in the storage means, for delivering the media individually;

transfer means, disposed above the storage means, for adhering by suction to each of the media stored in the storage means and transferring the media to the delivery means;

fluffing means, disposed beside the media stored in the storage means in a direction intersecting the medium delivery direction, for fluffing an upper-side region of the media in a state of being separated, by blowing air toward a side of the media during a feeding job of the media, wherein the feeding job of the media involves feeding a media into the delivery roller; and suppression means for suppressing movement of the media toward a delivery means side during air blowing performed by a controller connected to the suppression means and configured to control the fluffing means to blow air toward the side of the media during the feeding job of the media and continue to blow air during a post-feeding period which is a predetermined period after a completion of the feeding job of the media, wherein the storage means has a stopper wall which is disposed toward a side of the delivery means and is capable of retaining the media stored in the storage means when the fluffing means is not used, wherein the controller is configured to control the suppressing means to lower a position of a downstream end portion, in the medium delivery direction, of a medium fluffed during the air blowing in the post-feeding period to a position within a retainable region of the stopper wall, wherein the suppressing means has an air blowing unit that is controlled by the controller to blow air moving downward from an upper side toward the downstream end portion, in the medium delivery direction, of the medium fluffed during the air blowing in the post-feeding period, and the controller is configured to control the suppressing means to lower the position of the downstream end portion of the medium in the medium delivery direction in the post-feeding period, and wherein the air blower which is controlled by the controller to blows air downward from the upper side of the storage means toward the downstream end portion comprising:

the air blower which is controlled by the controller to blow air diagonally downward from the upper side of the storage means in a direction away from the delivery means, toward the downstream end portion of the medium in the medium delivery direction.

* * * * *